US006302389B1

(12) United States Patent
Kato et al.

(10) Patent No.: US 6,302,389 B1
(45) Date of Patent: Oct. 16, 2001

(54) SHEET TREATING APPARATUS AND IMAGE FORMING APPARATUS HAVING THE SAME

(75) Inventors: Katsuhito Kato; Yoshinori Isobe, both of Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/492,124

(22) Filed: Jan. 27, 2000

(30) Foreign Application Priority Data

Jan. 29, 1999 (JP) ..... 11-023247

(51) Int. Cl.[7] ..... B65H 39/10

(52) U.S. Cl. ..... 270/58.13; 270/58.28; 271/213; 271/217; 271/220; 399/410

(58) Field of Search ..... 399/407, 408, 399/410; 270/58.08, 58.09, 58.13, 58.28; 271/3.01, 220, 213, 214, 217, 218

(56) References Cited

U.S. PATENT DOCUMENTS 5,026,034 * 6/1991 Russel et al. ..... 271/220
5,098,074 * 3/1992 Mandel et al. ..... 270/58.13
5,350,169 * 9/1994 Hiroi et al. ..... 271/213
5,462,265 * 10/1995 Mandel et al. ..... 270/58.09
5,657,977 8/1997 Kato et al. ..... 270/52.14
5,742,890 4/1998 Kato et al. ..... 399/403
5,774,778 6/1998 Adachi et al. ..... 399/403
5,778,300 7/1998 Murakami et al. ..... 399/403
5,839,048 11/1998 Kato ..... 399/407
5,938,186 8/1999 Sato et al. ..... 270/58
5,951,000 9/1999 Sato et al. ..... 270/58.11
5,961,110 10/1999 Adachi et al. ..... 270/58
6,199,853 * 3/2001 Andoh et al. ..... 270/58.08

FOREIGN PATENT DOCUMENTS

0143167 * 6/1988 (JP) ..... 271/213

* cited by examiner

*Primary Examiner*—H. Grant Skaggs
(74) *Attorney, Agent, or Firm*—Fitzpatrick, Cella, Harper & Scinto

(57) ABSTRACT

A sheet treating apparatus includes a tray liftable and lowerable while sheets are stacked on the tray. A sheet pressing member is movable between a pressing position in which the sheets on the tray are pressed by the sheet pressing member and a retracted position. A sheet pressing member driving device retracts the sheet pressing member when the tray is lowered and for moving the sheet pressing member to the pressing position when the tray is lifted. A detecting device detects a height position of the sheets on the tray to stop lifting the tray.

9 Claims, 21 Drawing Sheets

SHEET TREATING APPARATUS AND IMAGE FORMING APPARATUS HAVING THE SAME

BACKGROUND OF THE INVENTION

1. Field of the Invention

The present invention relates to a sheet treating apparatus, and more particularly it relates to a sheet treating apparatus for successively receiving sheets such as copying paper discharged from an image forming apparatus such as a copying machine, a printing device or a laser beam printer after image formations and for effecting treatment such as alignment and stitching of the sheets and for discharging and stacking the treated sheets onto a stacking portion.

2. Related Background Art

In conventional image forming apparatuses such as printing devices, copying machines, printers or the like, sheets on which images are formed in a main body of the image forming apparatus are temporarily stacked on a treating tray (first stacking means) by a pair of discharge rollers (sheet discharging means) within a sheet treating apparatus, where, sheet treatment such as alignment and stitching of a sheet bundle is effected. Thereafter, the treated sheet bundle is bundle-discharged onto a stack tray (second stacking means) outside the main body by bundle discharging means.

A trailing end of the sheet bundle discharged on the stack tray is detected by a sheet surface height detecting sensor, and, on the basis of detection, an uppermost level of the sheets on the second stacking means is maintained to a predetermined level.

However, in such a conventional apparatus, if the sheet bundle discharged on the second stacking means is curled, erroneous detection of the sheet height is effected by the sheet height detecting sensor, so that the proper sheet height cannot be detected.

SUMMARY OF THE INVENTION

An object of the present invention is to provide a sheet treating apparatus capable of properly detecting a height of sheets on stacking means without being influenced by curl in the sheet discharged on the stacking means and capable of moving an upper level of the sheets to a proper position in an up-and-down direction.

A sheet treating apparatus according to the present invention comprises tray means liftable and lowerable while sheets are stacked on the tray means, a sheet pressing member movable between a pressing position in which the sheets on the tray means are pressed and a retracted position, sheet pressing member driving means for retracting the sheet pressing member when the tray means is lowered and for moving the sheet pressing means to the pressing position when the tray means is lifted, and detecting means for detecting a height position of the sheets on the tray means to stop lifting the tray means.

Further, the sheet pressing member may receive the discharged sheet in the pressing position.

Further, the sheets may be discharged in a sheet bundle and the tray means are lowered and lifted whenever the sheet bundle is discharged.

Furthermore, the sheet pressing member may include an engagement portion for holding a trailing end of the discharged sheet bundle, and a length of the engagement portion may be greater than a flying amount of the discharged sheet bundle.

In addition, the sheet surface height detecting means for detecting the trailing end of the sheet on the tray means may be disposed in the vicinity of the sheet pressing member.

According to the present invention, since there is provided the sheet pressing member capable of pressing the trailing end of the sheet discharged on the tray means with a simple construction and capable of being rotated to the sheet pressing position when the sheet is lifted and being retracted to the retracted position when the tray means is lowered, if curled sheets are stacked, proper sheet height can be maintained and can be detected by the sheet surface height detecting means, whereby the tray means can be maintained in a proper height.

Further, when the sheet is discharged on the tray means, since the sheets on the tray means are pressed, the sheet(s) on the tray means are not moved by the sheet being discharged, thereby not disordering the aligned sheets. Further, since the length of the pressing member is greater than the flying amount of the sheet bundle upon the discharge, the trailing end of the sheet bundle is prevented from being caught by the pressing member thereby not affecting a bad influence upon the alignment, thereby improving the stacking ability for stacking the sheets on the tray means.

DESCRIPTION OF THE PREFERRED EMBODIMENTS

Now, an embodiment of a sheet treating apparatus according to the present invention and an image forming apparatus having such a sheet treating apparatus will be explained with reference to the accompanying drawings.

Figure 1:
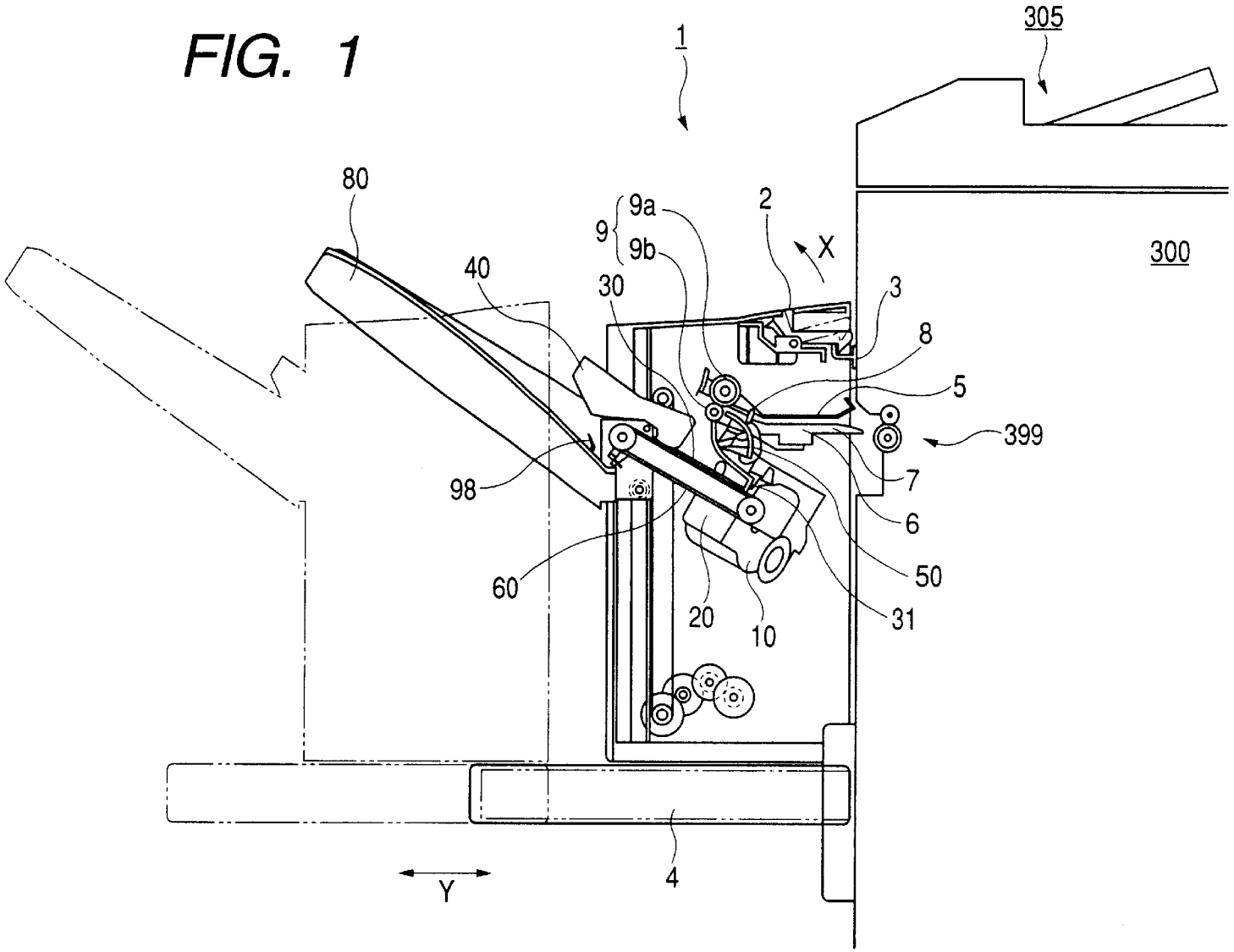
FIG. 1 is a sectional view showing the entire construction of a sheet treating apparatus according to the present invention.
Figure 2:
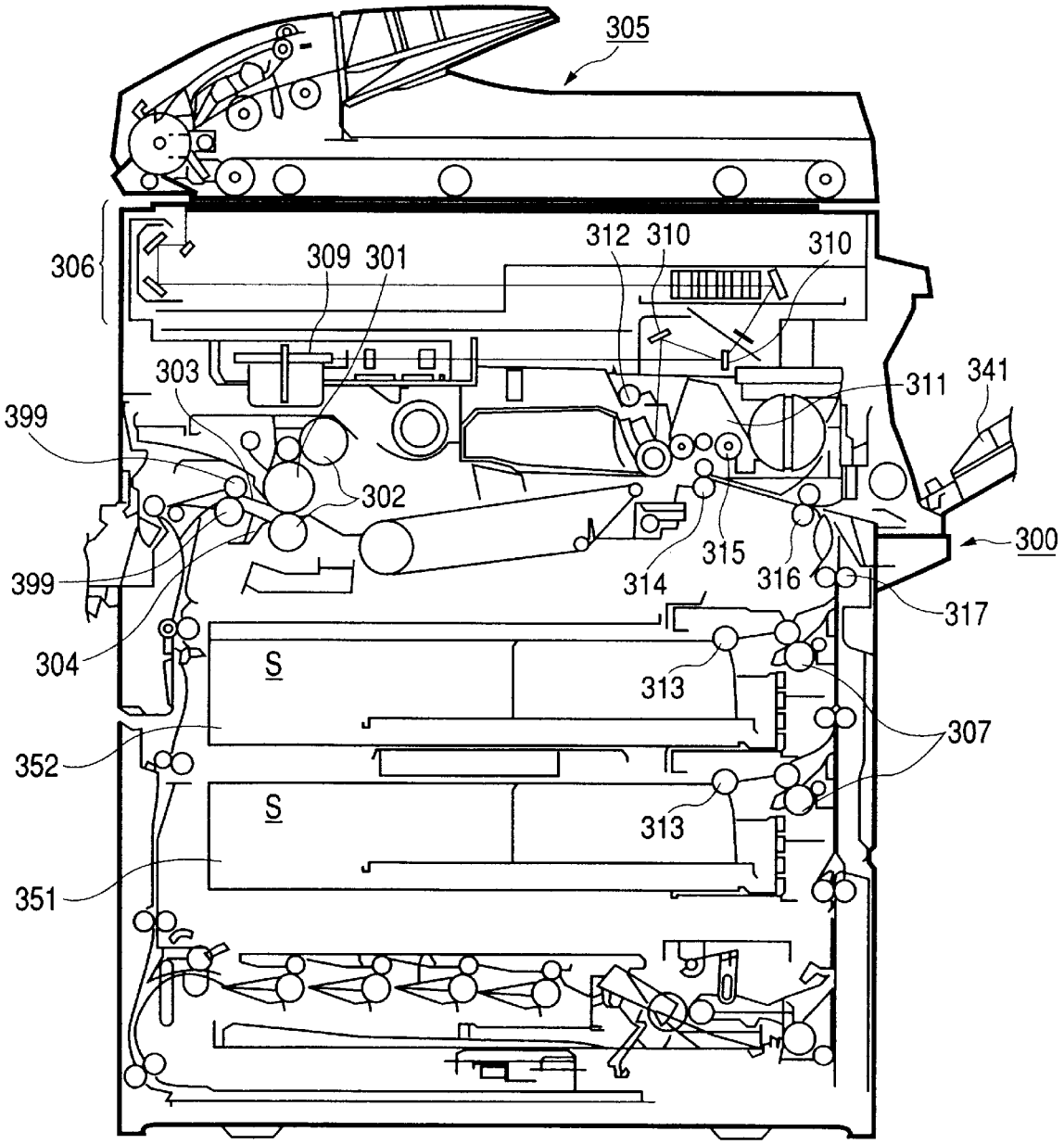
FIG. 2 is a vertical sectional front view showing an example of an image forming apparatus to which the sheet treating apparatus can be applied.

FIG. 1 is a sectional view showing a construction of the sheet treating apparatus according to the present invention, and FIG. 2 is a vertical sectional front view showing a construction of the image forming apparatus according to the present invention.

In FIG. 1, a sheet treating apparatus (finisher) 1 according to the invention is connected to a main body 300 of the image forming apparatus, and an original feeder (RDF) 305 of circulating type is rested on the main body 300 of the image forming apparatus.

As shown in FIG. 2, in the main body 300 of the image forming apparatus, an original is automatically fed by the original feeder 305 of circulating type and an image on the original is read by an image reading portion 306. In accordance with image information read by a controller (not shown), a signal is sent to a laser generator to emit a laser beam.

Then, the laser beam is reflected by a rotating polygon mirror 309 and is illuminated, through reflection mirrors 310, onto an electrophotographic photosensitive drum (image forming means) 312 a surface of which is uniformly charged, thereby forming an electrostatic latent image. The electrostatic latent image on the photosensitive drum 312 is developed by a developing device 311 as a toner image which is in turn transferred onto a sheet S such as a paper sheet or an OHP sheet.

The sheets S are selectively picked up from a sheet cassette 351 or 352 by a pick-up roller (sheet supplying means) 313 and are separated one by one by separation means 307, and the separated sheet is fed and conveyed up to a pair of registration rollers 314, 315 by pairs of ante-registration rollers 316, 317. Skew-feed of the sheet is corrected by the pair of registration rollers 314, 315, and then, the sheet is conveyed between the photosensitive drum 312 and an opposed transfer device in synchronism with rotation of the photosensitive drum (image forming means) 312. Under the action of the transfer device, the toner image formed on the photosensitive drum 312 is transferred onto the sheet S.

Thereafter, the sheet S is directed to a pair of fixing rollers 301, 302, and the sheet is heated and pressurized by the pair of fixing rollers 301, 302 to permanently fix the toner image to the sheet S. A fixing upper separation pawl 303 and a fixing lower separation pawl 304 are contacted with the pair of fixing rollers 301, 302, respectively so that the sheet S can be separated from the pair of fixing rollers 301, 302 by such pawls.

The separated sheet S is conveyed out of the main body 300 of the image forming apparatus by a pair of discharge rollers 399 of the main body and is directed to the sheet treating apparatus 1 connected to the main body 300 of the image forming apparatus.

In FIG. 1, the connection between the sheet treating apparatus 1 and the image forming apparatus is accomplished by positioning and attaching a lock arm 2 provided on an upper part of the sheet treating apparatus 1 to a hold member 3 attached to the image forming apparatus. Further, a slide unit 4 secured to the image forming apparatus is disposed at a lower part of the sheet treating apparatus so that the sheet treating apparatus 1 can be moved in a sheet discharging direction (direction indicated by the double-headed arrow Y in FIG. 1). If poor sheet conveyance occurs in the image forming apparatus or the sheet treating apparatus 1, when the sheet trapped in the main body is removed, the sheet treating apparatus 1 itself is moved away in the direction Y by rotating the lock arm 2 in a direction indicated by the arrow X, thereby detaching the sheet treating apparatus from the image forming apparatus.

The sheet S discharged from the pair of discharge rollers 399 of the main body is further sent to a downstream direction through a sheet path 7 defined by an upper guide 5 and a lower guide 6 within the sheet treating apparatus 1. A sheet detecting sensor 8 provided in the sheet path 7 serves to detect the passing sheet and the trapped sheet, and a pair of discharge rollers 9 comprise a discharge roller **9*a* and a discharge sub-roller 9*b* urged against the discharge roller 9*a***.

A treatment tray (sheet stocking means) 30 is constructed as an intermediate tray for temporarily stacking the sheets and for effecting alignment and stapling of the sheets.

A stapler 10 serves to staple a sheet bundle S on the treatment tray 30. In explanation of the illustrated embodiment, although a description regarding this stapler is provided, it may have a construction substantially the same as that of a commercially available automatic stapling device of an electrically driven type or a motor driven type in which staple is stuck into the sheet bundle to stitch the sheet bundle.

A bundle discharging belt 60 serves to bundle-convey the sheets S on the treatment tray 30 and to bundle-discharge the sheets on a stack tray 80.

A treatment tray unit 20 is disposed between a conveying portion for conveying the sheet S from the main body 300 of the image forming apparatus and the stack tray 80 for receiving and containing the sheet bundle S treated on the treatment tray 30.

The treatment tray unit 20 comprises the treatment tray 30, aligning means 40, a back roller 50 and the bundle discharging belt 60.

As shown in FIG. 1, the treatment tray 30 is an inclined tray with an upper downstream end (left end in FIG. 1) and a lower upstream end (right end in FIG. 1) in a sheet conveying direction, and the lower end is provided with a trailing end stopper 31.

The sheet S discharged by the pair of discharge rollers 9 is slid on the treatment tray 30 by the action of weight of the sheet itself, a sheet dropping member 102 (described later) and the back roller 50 until a trailing end of the sheet S abuts against the trailing end stopper 31. Further, the treatment tray 30 is provided with the bundle discharging belt 60 so that the bundle discharging belt 60 is moved in the sheet discharging direction by a motor 70 to discharge the sheet bundle S rested on the treatment tray 30 onto the stack tray 80.

In the above-described arrangement, although the construction in which the sheets discharged into the sheet treating apparatus 1 are staced on the treatment tray 30 and then are discharged onto the stack tray 80 is briefly described, the sheet dropping member portion, the back roller portion, the aligning means, the stack tray 80 and the sheet trailing end pressing portion which serve to stack the sheets discharged from the pair of discharge rollers 9 on the treatment tray 30 will now be explained successively.

<Sheet dropping member and sheet trailing end dropping member>

A sheet dropping member and a sheet trailing end dropping member will now be described with reference to FIGS. 5 to 12.

Figure 5:
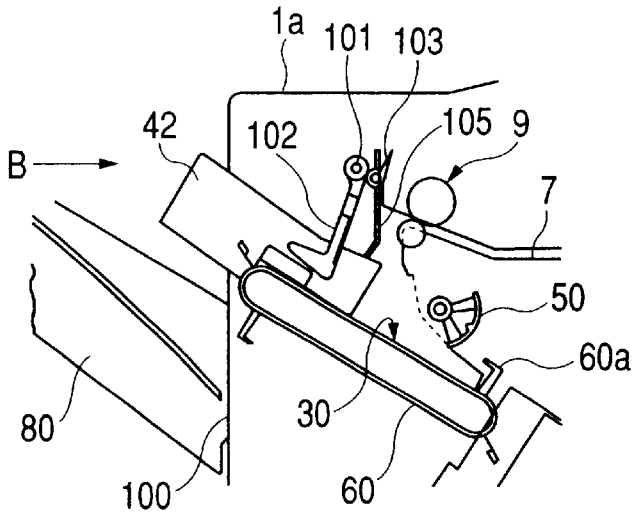
FIG. 5 is a side view showing a sheet dropping member and a sheet trailing end dropping member.
Figure 6:
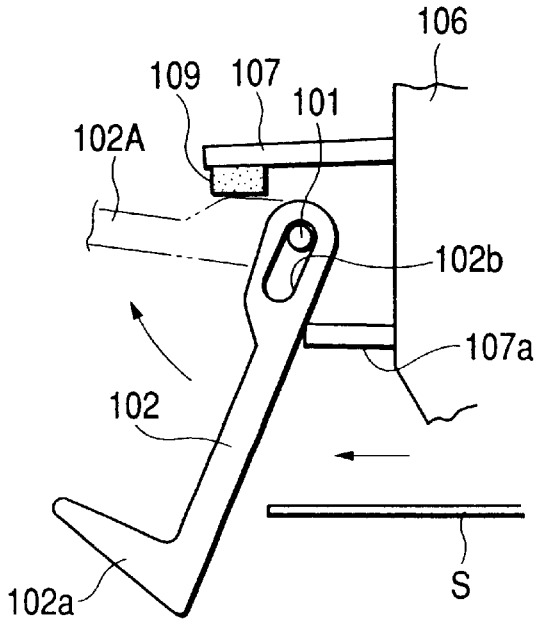
FIG. 6 is an enlarged side view of the sheet dropping member.

In FIGS. 5 and 6, in the vicinity of a downstream side of the pair of discharge rollers 9, there are provided a sheet dropping member 102 for guiding and dropping the discharged sheet S onto the treatment tray 30, and a sheet trailing end dropping member 105 for dropping the trailing end of the discharged sheet S. The sheet dropping member 102 is provided at its lower end with a pressing portion 102*a* for pressing an upper surface of the sheet S and is rotatable by loosely fitting an elongated slot 102*b* formed in an upper end of the member 102 onto a support shaft 101.

A stopper 107*a* having a proximal end secured to a fixed member 106 abuts against an upstream side of the sheet dropping member 102 to define an initial position of the sheet dropping member 102 which can be rotated by its own weight. A stopper 107 having a proximal end secured to the fixed member 106 is disposed above the sheet dropping member 102, and an elastic member 109 is provided on a lower surface of a free end of the stopper 107.

When the discharged sheet S is discharged forcibly in the direction indicated by the arrow and pushes the sheet dropping member 102, the sheet dropping member 102 strikes against the stopper 107. However, since the elastic member 109 is provided as mentioned above, the rotating force of the sheet dropping member 102 is absorbed, thereby preventing the bounding due to such collision. As a result, the sheet dropping member 102 presses the upper surface of the discharged sheet S by its own weight, so that the sheet S can be dropped onto the treatment tray 30 as will be described later. The bounding of the sheet dropping member 102 which will occur if there is no elastic member 109, and buckling of the sheet S due to the sheet bounding can be prevented.

Next, operations of the sheet dropping member 102 and the sheet trailing end dropping member 105 will be explained with reference to FIGS. 7 to 11. As will be described later in connection with FIG. 7, a plurality of sheet trailing end dropping members 105 are provided and serve to press the trailing end of the discharged sheet S and drop the sheet onto the treatment tray 30.

Figure 7:
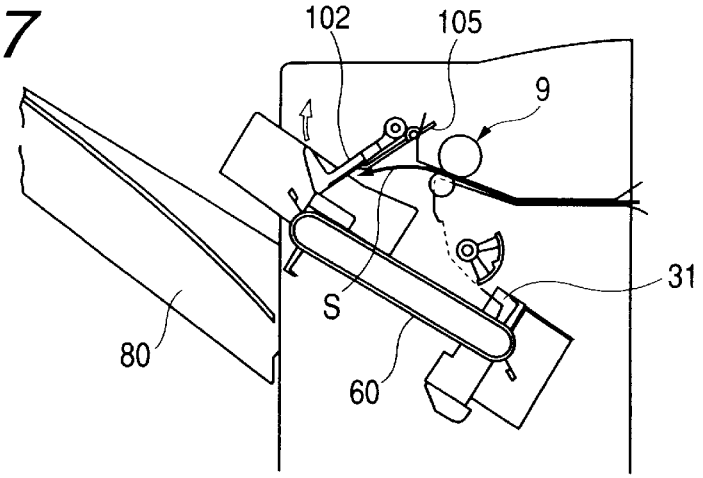
FIG. 7 is a view for explaining operations of the sheet dropping member and the sheet trailing end dropping member.
Figure 8:
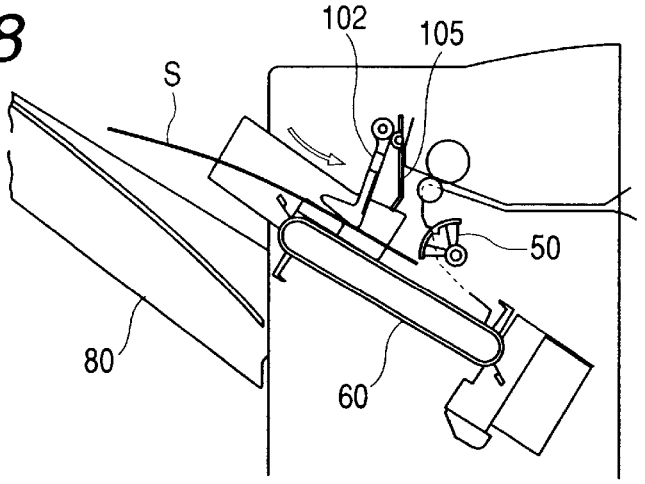
FIG. 8 is a view for explaining operations of the sheet dropping member and the sheet trailing end dropping member.
Figure 9:
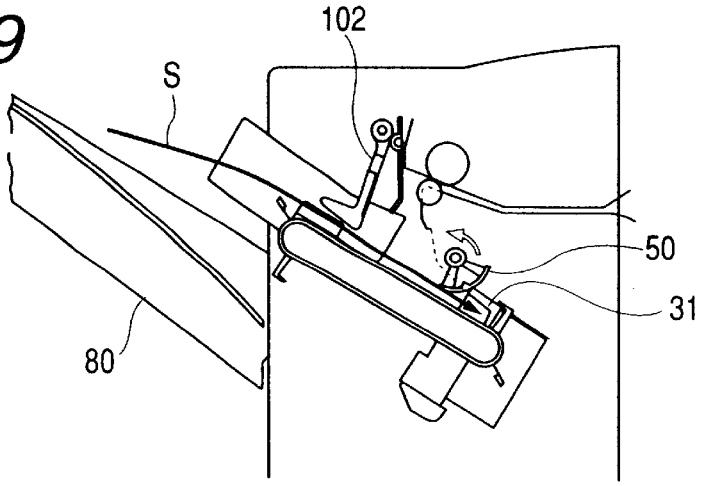
FIG. 9 is a view for explaining an operation of the back roller.
Figure 10:
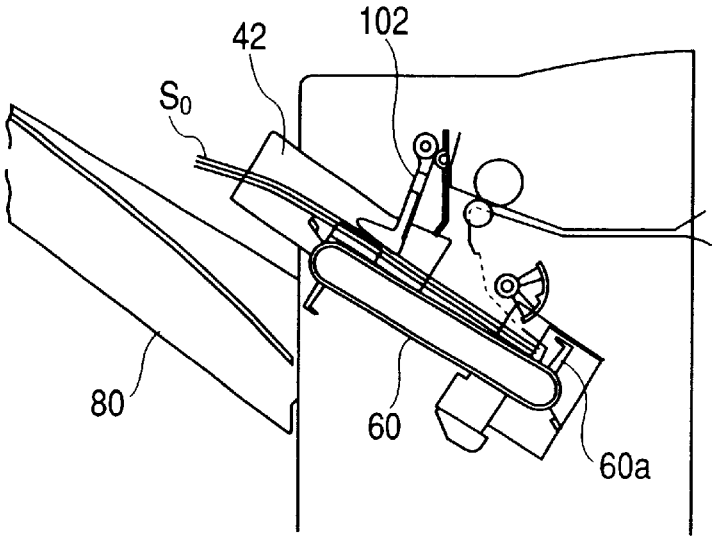
FIG. 10 is a side view showing the treat tray on which a sheet bundle is rested and a bundle discharging belt portion.
Figure 11:
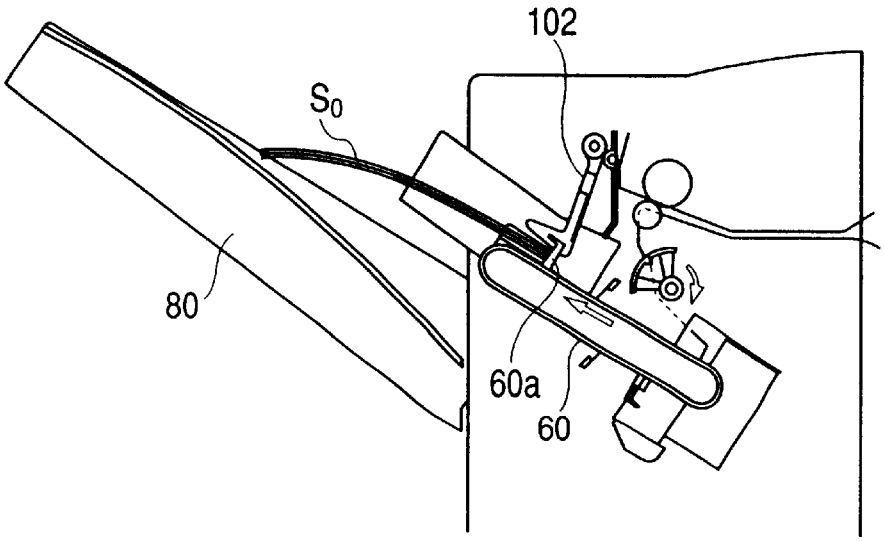
FIG. 11 is a view for explaining a bundle discharging operation of the bundle discharging belt.

As shown in FIG. 7, the sheet dropping member 102 drops the sheet S toward the treatment tray 30 while being rotated in the direction indicated by the arrow by the sheet S discharged by the pair of discharge rollers 9. When the trailing end of the sheet S leaves the pair of discharge rollers 9, as shown in FIG. 8, the sheet dropping member 102 is rotated in a direction indicated by the arrow by its own weight. When the sheet dropping member 102 is rotated, the sheet S is moved toward the trailing end stopper 31 (FIG. 7). As will be described later, the sheet S is further moved up to the trailing end stopper 31 by the back roller 50 and is aligned (FIG. 9). As shown in FIG. 10, when a predetermined number of sheets S are stacked on the treatment tray 30, the bundle discharging belt 60 and a hook portion 60*a* integral with the belt 60 are rotated to bundle-discharge a sheet bundle $S_0$ onto the stack tray 80, as shown in FIG. 11.

Next, the sheet trailing end dropping member 105 will be fully described with reference to FIG. 12.

Figure 12:
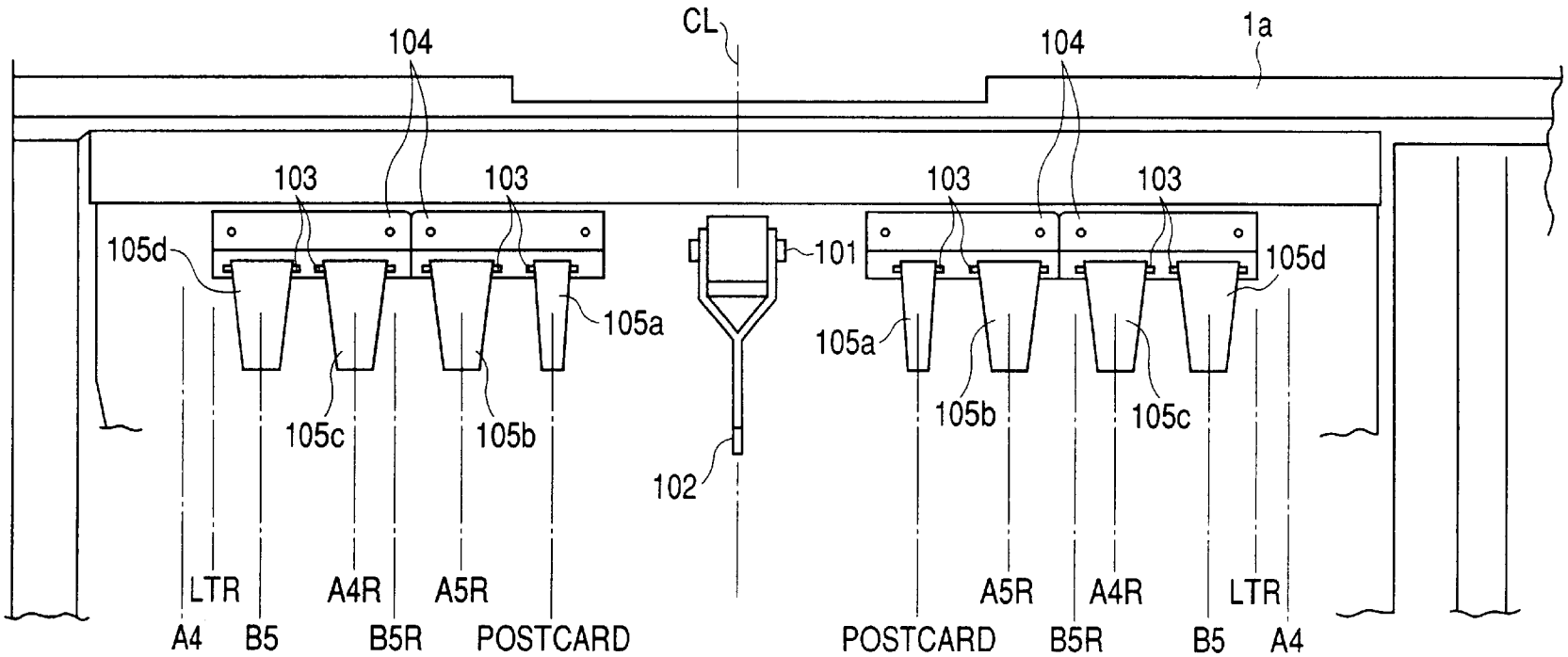
FIG. 12 is a front view of the sheet trailing end dropping member, looking in a direction indicated by the arrow B in FIG. 5.

In FIG. 12, the sheet dropping member 102 is disposed at a center CL of the sheet discharging portion, and a plurality of sheet trailing end dropping members 105*a*, 105*b*, 105*c*, 105*d* are symmetrically arranged on both sides of the sheet dropping member 102. Each of the sheet trailing end dropping members 105*a* to 105*d* is rotatably supported by a support plate 104 via a support shaft 103.

Each of the sheet trailing end dropping members 105*a* to 105*d* is arranged to press the trailing end of the sheet in accordance with a size of the discharged sheet S.

That is to say, when the discharged sheet S is a "post card", the trailing end of the sheet is pressed by the sheet trailing end dropping members 105*a*, and, when the discharged sheet has A5R or B5R size, the trailing end of the sheet is pressed by the sheet trailing end dropping members 105*a*, 105*b*, and, when the discharged sheet has A4R size, the trailing end of the sheet is pressed by the sheet trailing end dropping members 105*a* to 105*c*, and, when the discharged sheet has B5, LTR or A4 size, the trailing end of the sheet is pressed by the sheet trailing end dropping members 105*a* to 105*d*.

As mentioned above, by providing the sheet trailing end dropping members divided into the plural members for pressing the trailing end of the sheet in accordance with the size of the discharged sheet S, a phenomenon that the small size sheet is pressed by a large sheet trailing end dropping member to cause the buckling of the sheet can be prevented.

<Back roller>

Next, the back roller 50 will be explained with reference to FIG. 3 and FIGS. 4A, 4B, 4C and 4D. As shown in FIGS. 4A to 4D, the back roller 50 has a less-half circular configuration and secured to a back roller shaft 51 for swinging movement and is biased by a spring 52 to assume an arc shape around the back roller shaft 51.

Figure 3:
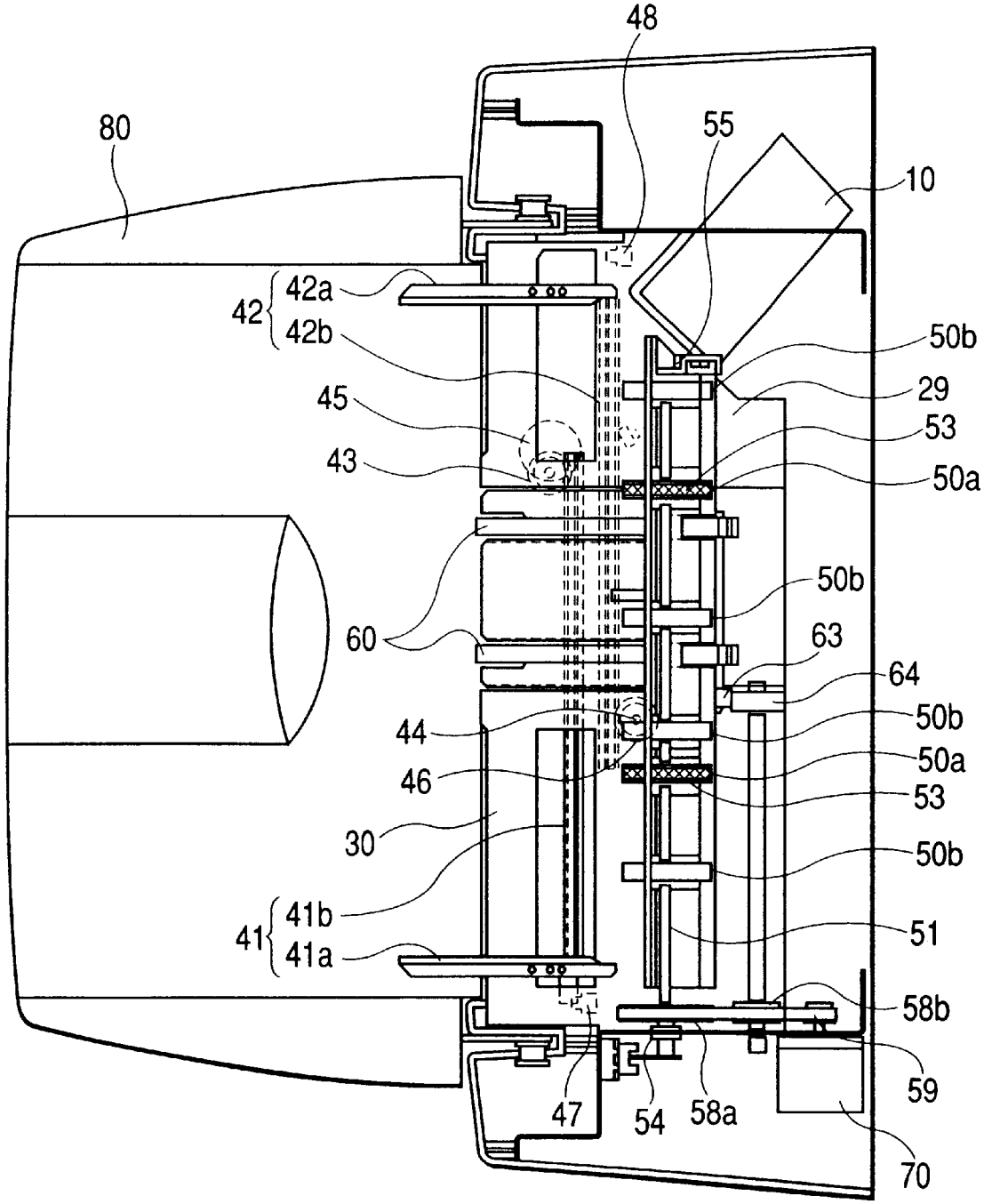
FIG. 3 is a plan view showing a moving mechanism for a back roller and an aligning member provided on a treatment tray.

In FIG. 3, the back rollers 50 are attached to the back roller shaft 51 at predetermined intervals in a sheet width direction and include back rollers 50*a* each having a friction member 53 such as silicone rubber at its arc periphery and back rollers 50*b* not having such friction members 53.

The back roller shaft 51 is supported by bearings 54, 55 for rotational movement with respect to front and rear side plates and for movement in a thickness direction of the sheets S stacked on the treatment tray 30, and urging springs 56, 57 are mounted on the bearings 54, 55.

The back roller shift 51 is connected to a motor 70 via a pulley 58 and a timing belt 59 so that, when back rollers 50 receives a driving force from the motor 70, the back rollers 50 are rotated together with the back roller shaft 51 around the back roller shaft 51 in an counterclockwise direction in FIGS. 4A to 4D.

Figure 4A:
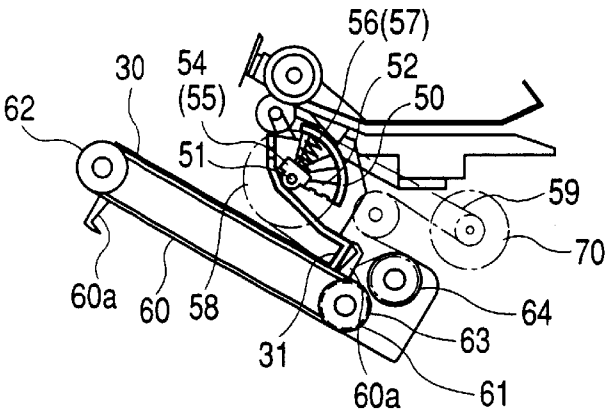
FIGS. 4A, 4B, 4C and 4D are side views showing operations of the back roller and a bundle discharging belt.

As shown in FIG. 4A, a home position of each back roller 50 is selected as a position where the back roller does not abut against the sheet S discharged onto the treatment tray 30 by the pair of discharge rollers 9.

Figure 4B:
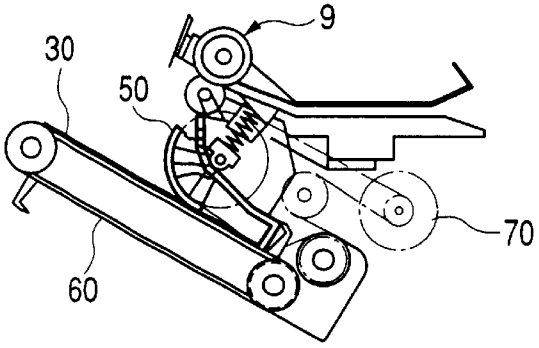
Figure 4C:
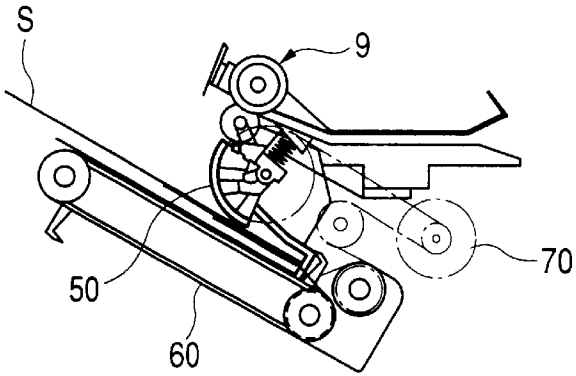

When the sheet S is discharged from the pair of discharge rollers 9, as shown in FIG. 4B, the back rollers 50 are rotated through one revolution around the back roller shaft 51 in the counterclockwise direction in FIGS. 4A to 4D by the driving force of the motor 70, thereby drawing the sheet S until the sheet abuts against the trailing end stopper 31.

If the discharged sheet S leans against the lower guide, ends of the back rollers 50 catch the trailing end of the sheet S, with the result that the back rollers are rotated through one revolution around the back roller shaft 51 in the counterclockwise direction in FIGS. 4A to 4D while scraping the trailing end of the sheet S, thereby landing the sheet S on the treatment tray 30 surely and drawing the sheet until the sheet abuts against the trailing end stopper 31. Thereafter, the back rollers 50 are stopped at their home position, therbey preparing for discharging a next sheet S.

<Aligning means>

Next, the aligning means 40 will be described with reference to FIG. 3 and FIGS. 13 to 16.

The aligning means 40 has a this side (front side) aligning member 41 and a that side (rear side) aligning member 42 which can be moved independently in a direction (width direction) perpendicular to the sheet conveying direction. The aligning members 41, 42 are provided with aligning plates 41*a*, 42*a* for abutting against and regulating both lateral edges of the sheet in a condition that the plates stand on the treatment tray 30, and rack gears 41*b*, 42*b* extending in a width direction of the treatment tray 30.

Figure 15:
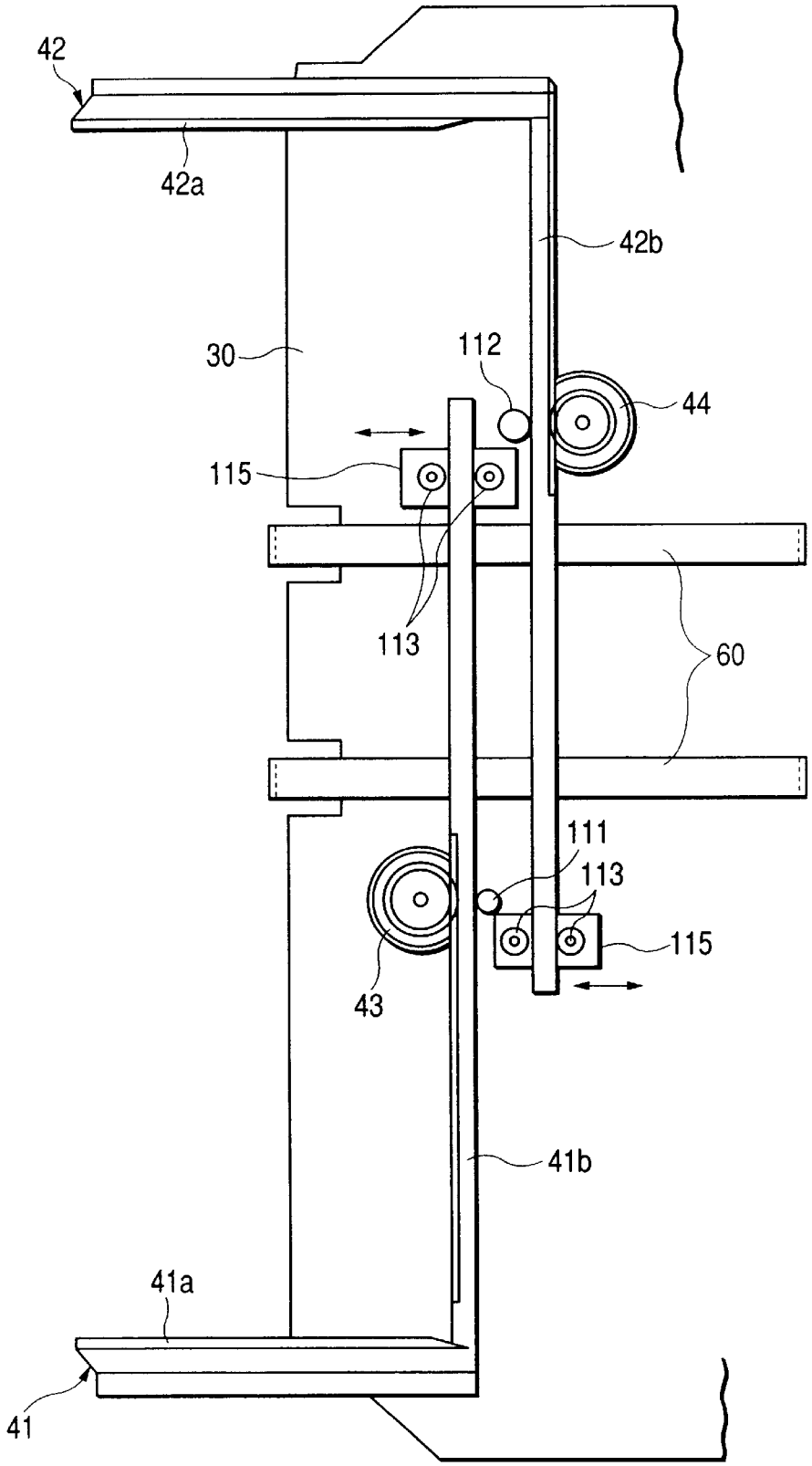
FIG. 15 is a plan view of the aligning member and a driving portion therefor.
Figure 16:
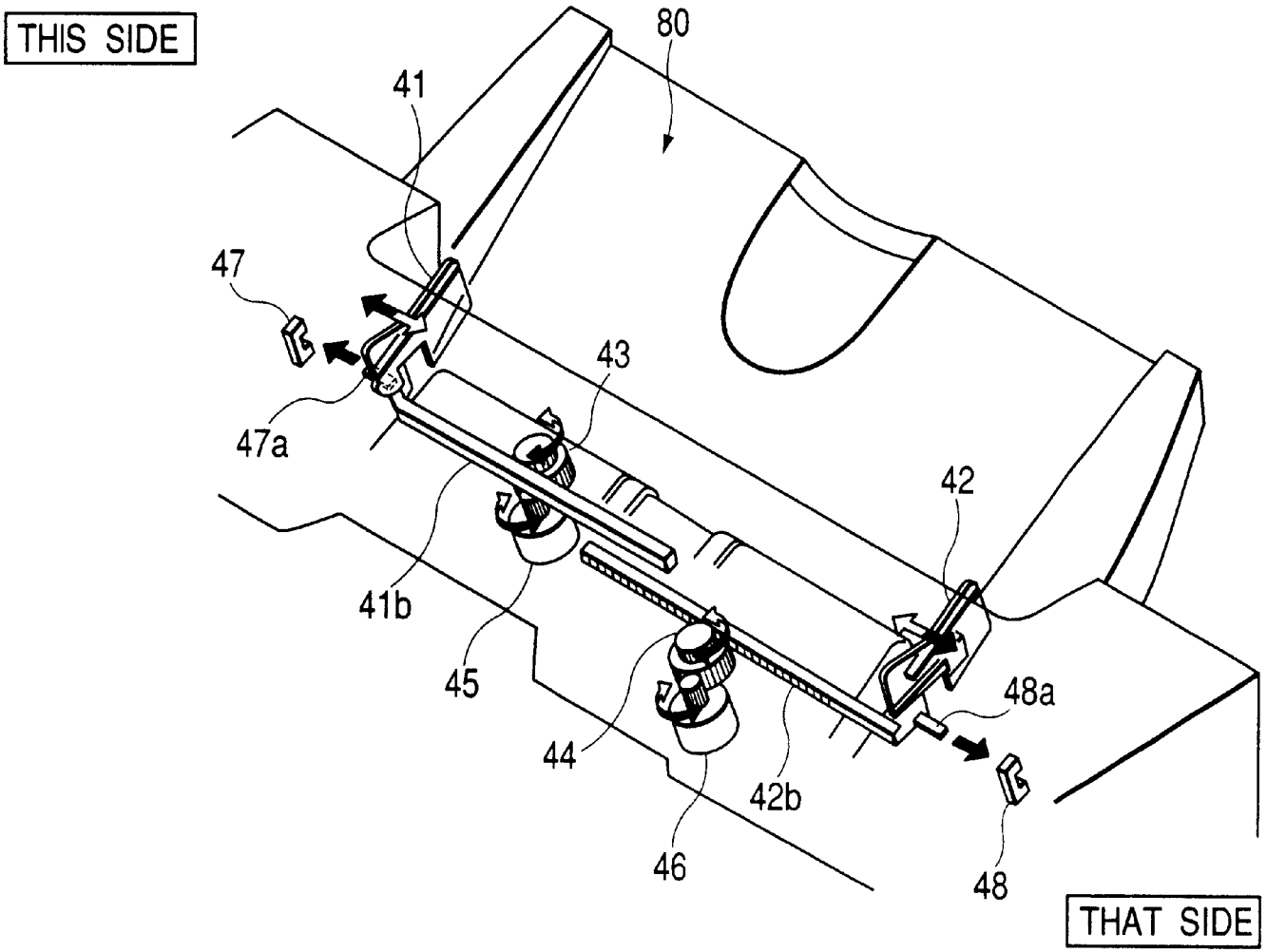
FIG. 16 is a perspective view of the aligning member and the driving portion therefor.

The aligning members 41, 42 are assembled so that the aligning plates 41*a*, 42*a* extend above the treatment tray 30 and the rack gears 41*b*, 42*b* are positioned below the treatment tray 30. In FIGS. 15 and 16, a pinion gear 43 comprising two-stage gear is meshed with the rack gear 41*b* of the aligning plate 41 on this side, and a guide sub-roller 111 for cooperating with the pinion gear 43 to hold the rack gear 41*b* abuts against an opposite surface of the rack gear 41*b*. As shown in FIG. 16, a large gear of the pinion gear 43 is meshed with a drive gear of an aligning motor 45 on this side.

Further, a free end of the rack gear 41*b* is movably pinched between a pair of guide sub-rollers 113 rotatably provided on a support member 115. The guide sub-rollers 113 can slightly be moved in a direction indicated by the arrow (sheet conveying direction) so that, when the aligning plate 41 is assembled, after the position of the guide sub-rollers 113 are adjusted, an attachment state of the aligning plate 41a can be adjusted.

Similarly, the rack gear 42*b* of the aligning plate 42 on that side is also moveably pinched between a pinion gear 44 and a guide sub-roller 112, and a free end of the rack gear 42*b* is also movably pinched between similar guide sub-rollers 113. By adjusting the position of the guide sub-rollers 113 in the direction indicated by the arrow, an attachment state of the aligning plate 42*a* on that side can be adjusted.

As a result, by normal and reverse rotations of the aligning motor 45, 46, the pinion gears 43, 44 are rotated, with the result that the rack gears 41*b*, 42*b* meshed with the pinion gears 43, 44 are also moved, thereby moving the aligning members 41, 42 in the width direction of the sheet S.

Incidentally, the aligning members 41, 42 are provided with sensors 47, 48 for detecting home positions of the aligning members 41, 41. The sensors 47, 48 detect flags 47*a*, 48*a* provided on the rack gears 41*b*, 42*b*, respectively. Normally, the aligning members 41, 42 are waiting at their home positions. In the illustrated embodiment, the home position of the aligning member 41 on this side is set at a most at this side, and the home position of the aligning member 42 on that side is set at a most at that side.

Next, configurations and supporting structure of the aligning members 41, 42 will be explained. In the illustrated embodiment, only the aligning member 41 on this side will be described, and explanation of the side aligning member 42 having the similar construction will be omitted.

Figure 13:
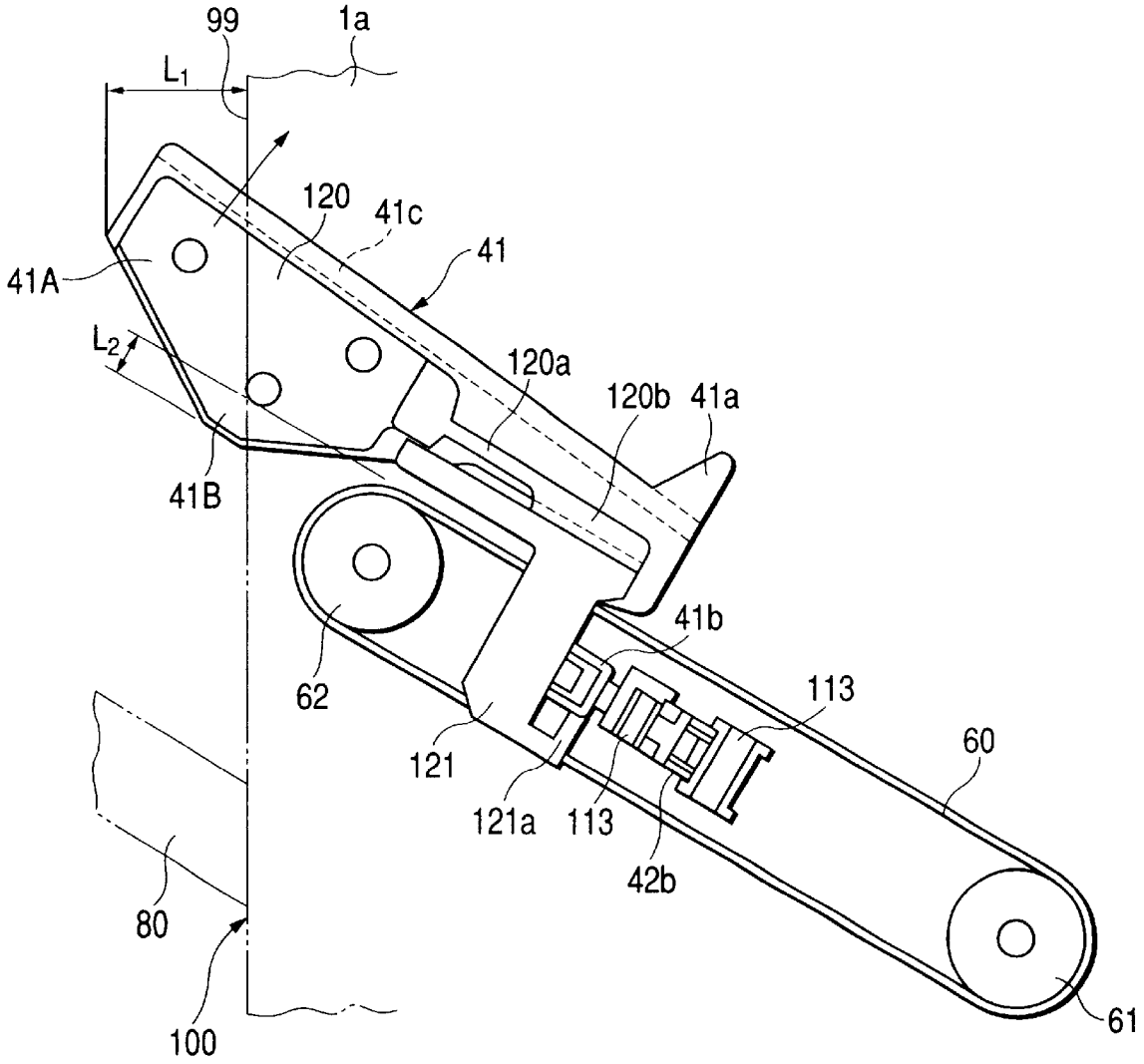
FIG. 13 is a side view of an aligning means portion and the bundle discharging belt portion.

In FIG. 13, an elastic member 120 is secured to an outer side of the aligning plate 41 and a base portion of the elastic member 120 is secured to an upper part of a support member 121. A lower part 121*a* of the support member 121 is secured to the rack gear 41*b* of the aligning plate 41*a* on this side. The elastic member 120 is provided at its central portion with an elastic portion 120*a* for permitting inclination of the aligning plate 41*a* about the base portion of the elastic member 120.

As mentioned above, by supporting the aligning plate 41*a* by the elastic member 120 having the elastic portion 120*a*, upon lifting the stack tray 80, even if the lifting/lowering motor steps out for any reason so that the stack tray 80 strikes against the aligning plate 41 (42), an extended portion 41A of the aligning plate 41 is retracted inwardly to the inside of a guide surface 99 of an outer wall 100, the thereby preventing damage of the aligning plate 41*a*.

Further, the rack gear 41*b* integral with the aligning plate 41 and the rack gear 42*b* integral with the aligning plate 42 extend through the inside of the bundle discharging belt 60 (between a tension side and a loose side) for discharging a sheet bundle onto the treatment tray 30. By arranging the rack gears 41*b*, 42*b* in the inside of the bundle discharging belt 60 as mentioned above, rather than the outside of the bundle discharging belt 60, dimensions of the aligning plates 41, 42 and the bundle discharging belt 60 in a height direction can be reduced, thereby making the apparatus more compact.

As shown in FIG. 13, a downstream end of the aligning plate 41 is protruded from the guide surface 99 of the outer wall of the main body 1*a* of the apparatus by a distance of $L_1$. Thus, when the sheet bundle $S_0$ is aligned by the aligning plates 41, 42, an aligning length along the sheet conveying direction is increased and central portion of the sheet bundle can be aligned, thereby improving the aligning ability for sheets.

Further, a lower end of the aligning plate 41 is protruded downwardly from the stacking surface of the treatment tray 30 by a distance of $L_2$. Thus, sheets S extended from the treatment tray 30 toward the stack tray 80 can be aligned, thereby improving the aligning ability for sheets.

Figure 14:
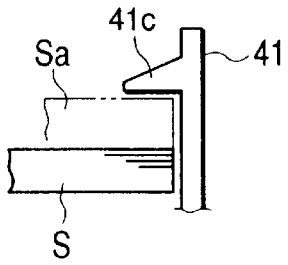
FIG. 14 is a vertical sectional front view showing a regulating portion formed on an aligning plate.

As shown in FIG. 14, a regulating portion 41c directing inwardly (toward the center of the treatment tray 30) is formed on an upper part of an inner surface of the aligning plate 41. Thus, if the sheet is curled in the width direction, as shown by the alternate long and two short dashes line in FIG. 14, the lateral edge of the sheet is regulated by the regulating portion 41*c*, thereby preventing distortion of the stacked sheets. Further, if the sheet is curled along the sheet conveying direction, the lateral edge of the sheet is regulated by the regulating portion 41*c*, thereby improving the sheet stacking ability. A guide portion 41*a* protruding upwardly is provided on an upper part of the upstream end of the aligning plate 41. The guide portion 41*a* has an inner surface comprising a low friction member so that the sheet S discharged from the pair of discharge rollers 9 can smoothly be brought into the aligning plates 41, 42. An upper part of the guide portion 41*a* may be inclined outwardly to guide the sheet S further smoothly.

Next, the bundle discharging belt 60 will be explained with reference to FIGS. 3 and 4A to 4D. As shown in FIGS. 4A to 4D, the bundle discharging belt 60 is provided with hook portions 60*a*, and the bundle discharging belt 60 is extended around pulleys 61, 62, and the pulley 61 is connected to the motor 70 via a gear 63, a one-way gear 64 and a timing belt 59. The one-way gear 64 can transmit a driving force to the gear 63 only when the motor 70 is rotated in a clockwise direction.

Figure 4D:
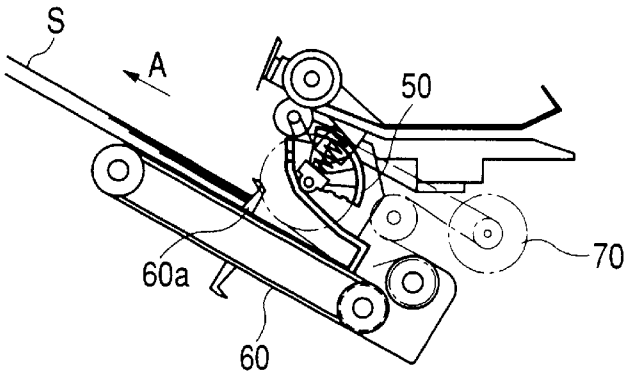

When the back rollers 50 draw a last sheet S until such a sheet abuts against the trailing end stopper 31, the bundle discharging belt 60 is driven by the motor 70 to be moved in a direction indicated by the arrow A (sheet conveying direction) in FIG. 4D substantially along the inclination of the treatment tray 30, so that the sheet bundle S aligned and stapled on the treatment tray 30 is discharged onto the stack tray 80.

Next, states of the aligning plates 41, 42 when the sheets discharged on the treatment tray 30 are aligned and when the sheet bundle is discharged from the treatment tray 30 will be explained.

As will be described later in connection with "sheet flow", in the aligning plates 41, 42, although one of the aligning plates urges the sheets S against the other stationary aligning plate to align the sheets, when the aligned sheet bundle is discharged, since the sheet bundle is frictionally slid on the aligning surfaces of the aligning plates 41, 42 so that a great bundle discharging force is required, the motor 70 for the bundle discharging belt 60 for discharging the sheet bundle may step out.

In the illustrated embodiment, although a distance between the aligning plates 41 and 42 is set so that the aligning plates abut against the lateral edges of the sheet bundle when the sheets are aligned, when the sheet bundle is discharged, the distance between the aligning plates 41 and 42 is slightly widened (for example, by 1 mm) by controlling the rotation of the motor 70 comprising a pulse motor. The control for widening the distance between the aligning plates 41 and 42 in this way is effected by a control device (control means) 150 shown in FIG. 25.

In this way, the aligned sheet bundle can smoothly be discharged onto the stack tray 80 by the bundle discharging belt 60, and, upon bundle discharge, load on the motor 70 can be reduced, endurance of the aligning plates 41, 42 can be improved and poor sheet bundle discharging can be prevented.

<Stack tray and sheet trailing end pressing member>

Next, a construction of the stack tray 80 will be described with reference to FIGS. 17 and 18. The stack tray 80 has a sub-tray 79 therein, so that, by extending the sub-tray 79, sheets having large size such as A3 or B4 size can be stacked.

Further, both sides of the stack tray 80 are supported by tray support plates 81, 82 which are secured to timing belts 83, 84, respectively.

The timing belt 83 is extended around pulleys 85, 86 and the timing belt 84 is extended around pulleys 87, 88, and the pulleys 86, 88 are secured to a drive shaft 90 to which a drive gear 89 is secured. The drive gear 89 is connected to a drive motor (driving means) 92 through a gear train 91.

Figure 17:
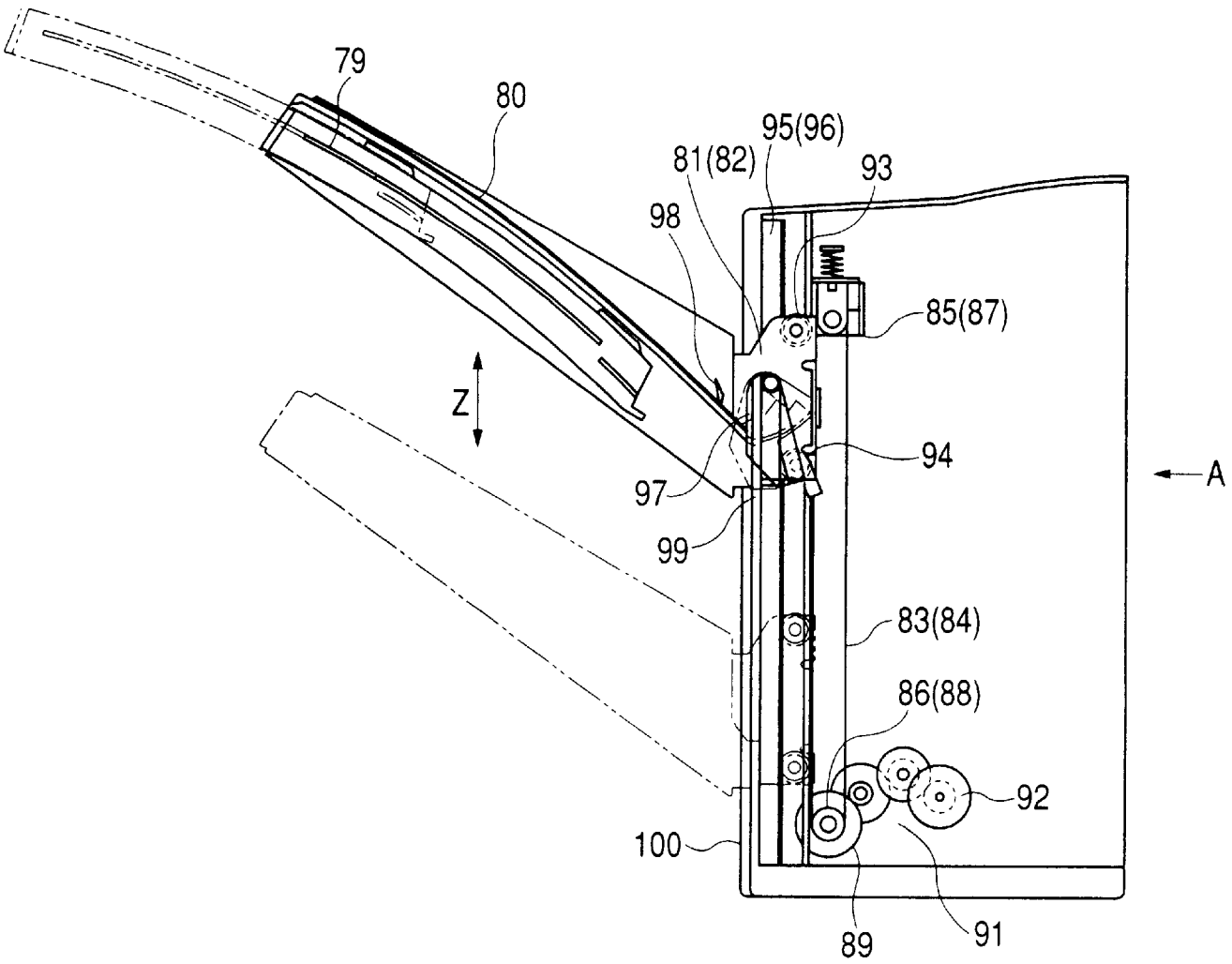
FIG. 17 is a vertical sectional side view showing a moving mechanism for a stack tray.
Figure 18:
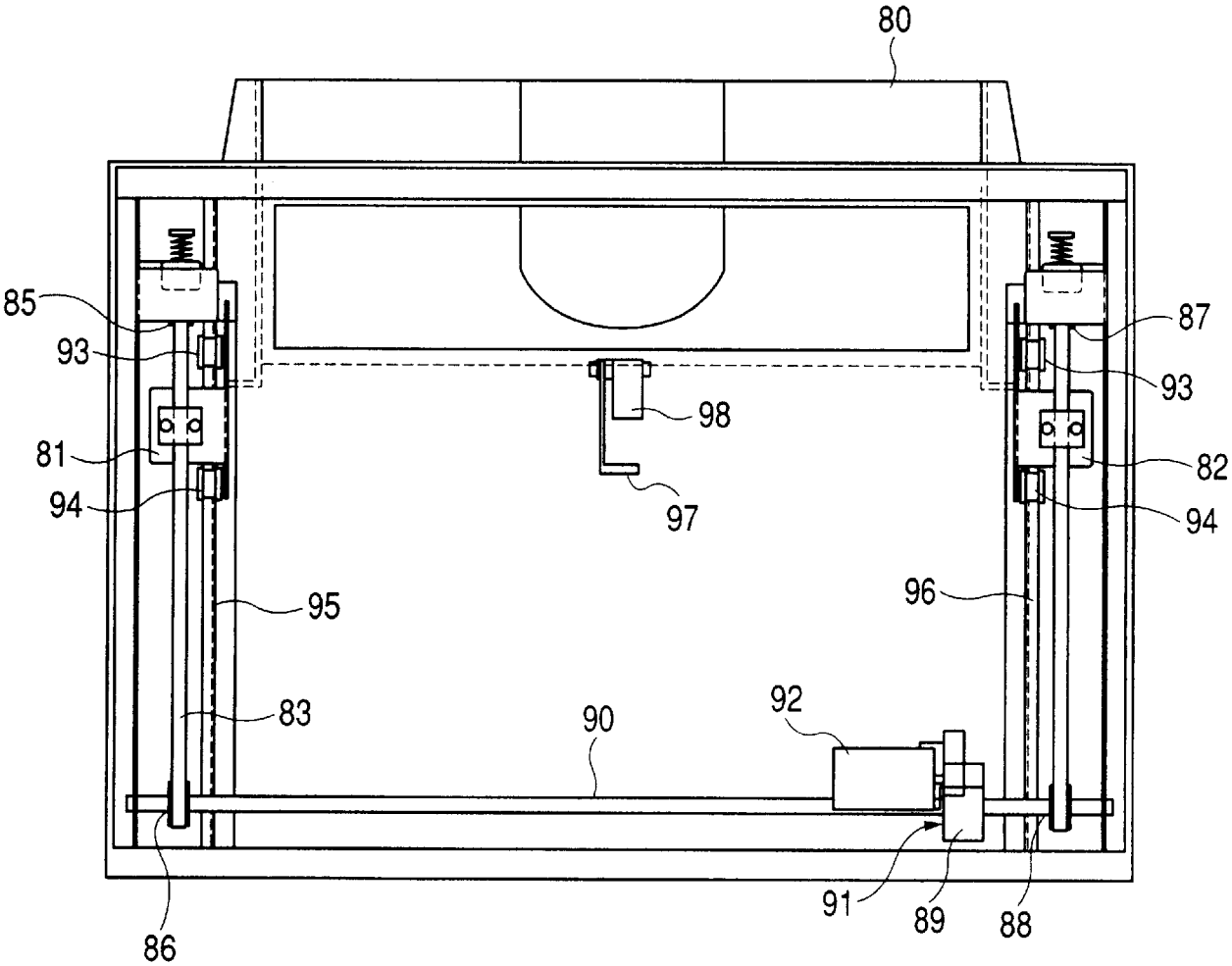
FIG. 18 is a back view showing the moving mechanism for the stack tray, looking in a direction indicated by the arrow A in FIG. 17.

Sub-rollers 93, 94 are attached to the tray support plates 81, 82 for rotation with respect to sub-roller guides 95, 96, so that, when a driving force from the drive motor 92 is transmitted, the tray support plates are moved in an up-and-down direction (directions indicated by the double-headed arrow Z in FIG. 17).

A sheet surface height detecting sensor (first sheet surface height detecting means) 97 serves to detect a height of the stacked sheet bundle, thereby adjusting a height of the stacking surface of the stack tray 80 with respect to the treatment tray 30 to a predetermined value.

A sheet trailing end pressing member 98 can be extended from and retracted into the guide surface 99 in response to the lifting/lowering movement of the stack tray 80 to press the trailing end of the sheet bundle S rested on the stack tray 80, thereby preventing the sheets from being deviated in the sheet discharging direction after the sheet bundle is discharged. The sheet surface height detecting sensor 97 is disposed in the vicinity of the sheet trailing end pressing member 98. By arranging the sheet surface height detecting sensor 97 as mentioned above, a height level of the sheets stacked on the stack tray 80 can be detected accurately without being influenced by curl in the sheet(s) S.

Figure 19:
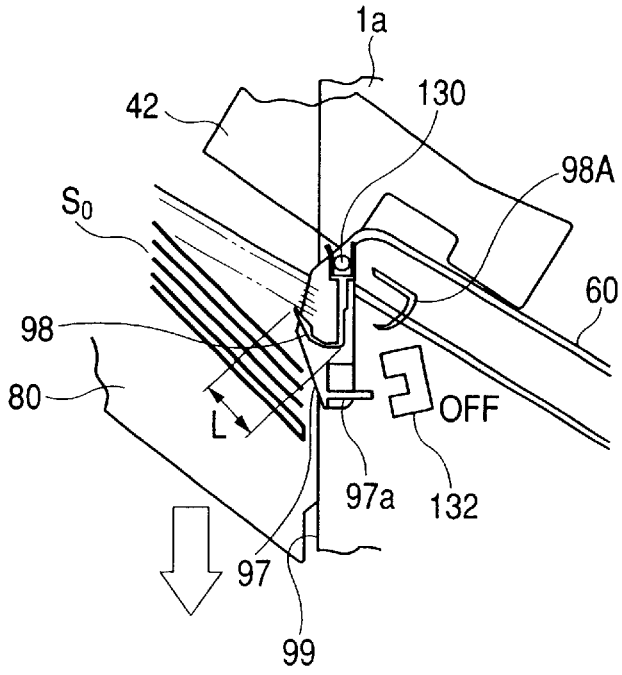
FIG. 19 is a side view of a sheet surface height detecting sensor and the sheet trailing end pressing member when a lowering of the stack tray is started.
Figure 20:
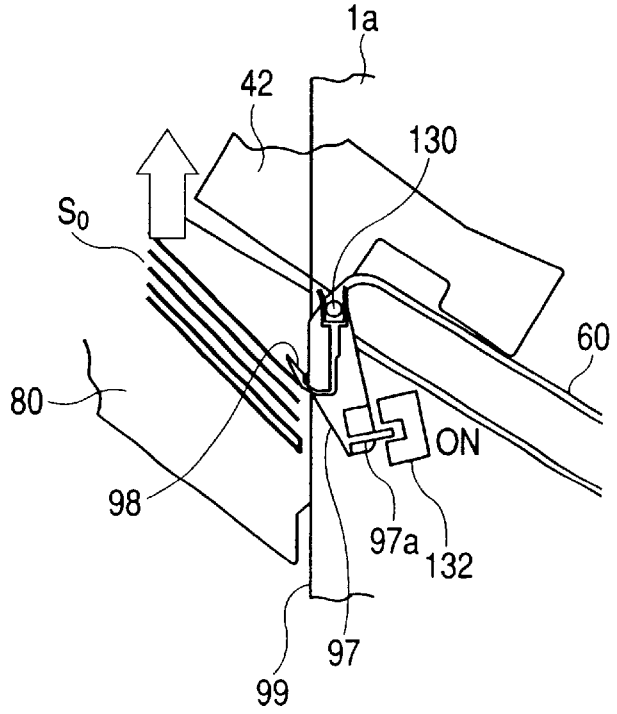
FIG. 20 is a side view of the sheet surface height detecting sensor and the sheet trailing end pressing member when a lifting of the stack tray is started.
Figure 21:
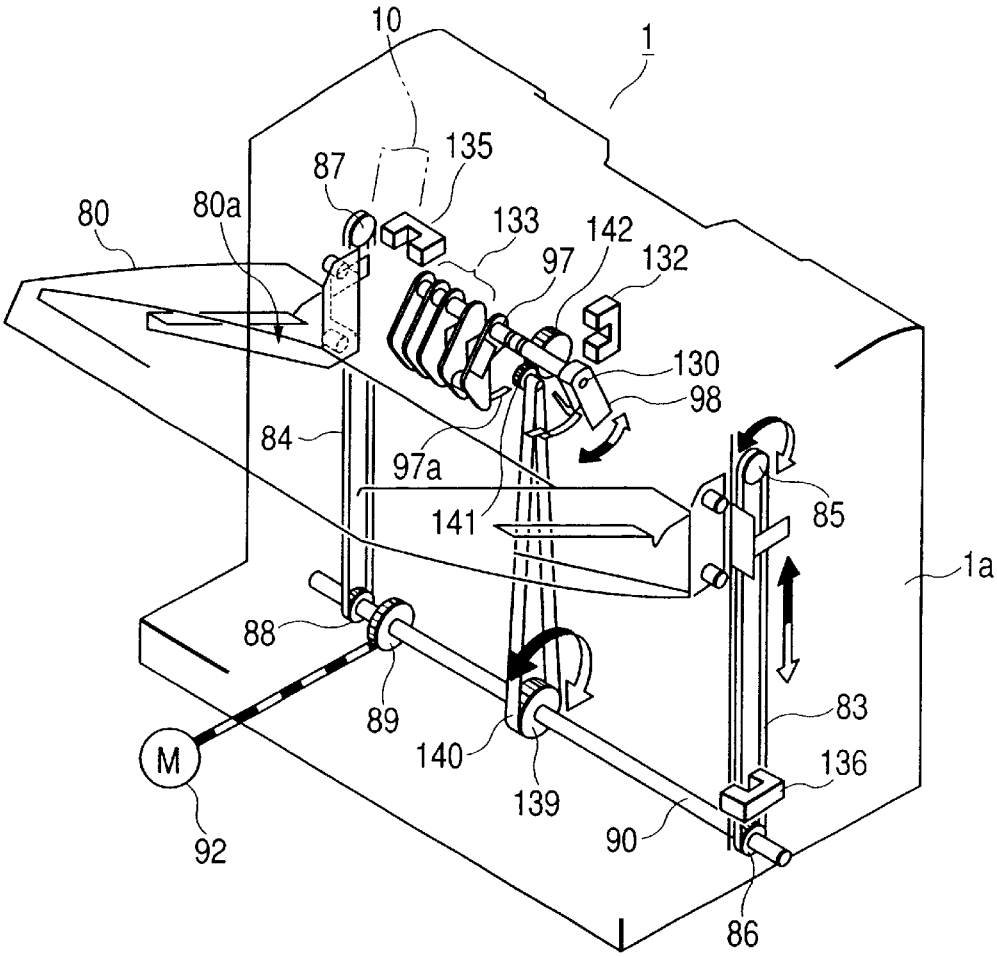
FIG. 21 is a perspective view of the sheet surface height detecting sensor, the sheet trailing end pressing member and a driving portion therefor.

FIGS. 19 and 20 are side views showing detection of the sheet surface height of the sheet bundle on the stack tray 80. FIG. 21 is a perspective view showing the detection.

In FIGS. 21 to 24, a gear 139 is secured to the drive shaft 90 which is forwardly and reversely rotated by the drive motor 92, and a rotational driving force of this gear 139 is transmitted to a pinion of a drive gear 141 through a timing belt and then is transmitted to a sector gear 143 through an intermediate gear 142. The sheet trailing end pressing member 98 is attached to a support shaft 130 integral with the sector gear 143, so that, by the forward and reverse rotations of the drive motor 92, the sheet trailing end pressing member 98 is moved between a sheet pressing position and a retracted position in the main body la of the apparatus.

A sheet surface height detecting sensor (second sheet surface height detecting means) 133 for detecting a sheet surface height at a stapler 10 side is rotatably provided on the support shaft 130, as well as the sheet surface height detecting sensor 97 and is biased to be protruded toward the stack tray 80. The sheet surface height detecting sensors 97, 133 are constructed integrally with each other so that, when the sensors are urged against the sheet S on the stack tray 80, they are moved into the main body 1*a* of the apparatus thereby to detect the sheet surface height by a flag 97*a* of the sheet surface height detecting sensor 97 and a photo-interrupter 132.

Incidentally, since the sheet bundle is stitched at a left upper corner of an imaged surface, in a relation or condition of the stapler 10 shown in FIG. 3, the sheet is discharged onto the stack tray 80 with an upper edge of the imaged surface directing toward that side and with the imaged surface facing downwardly.

Figure 23:
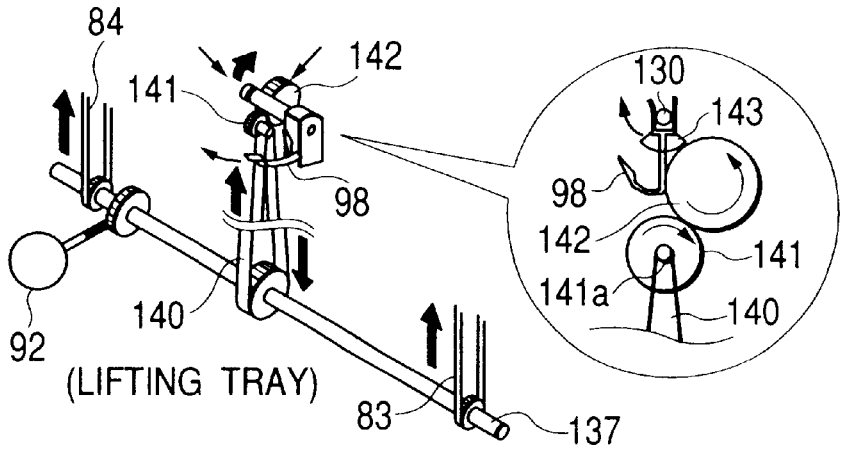
FIG. 23 is a perspective view showing the driving portion for the sheet surface height detecting sensor and the sheet trailing end pressing member when the stack tray is lifted.
Figure 24:
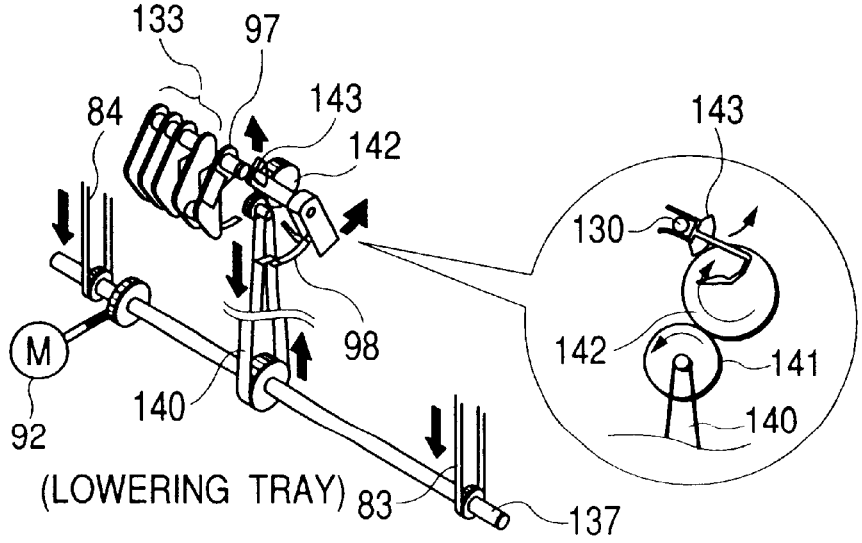
FIG. 24 is a perspective view showing the driving portion for the sheet surface height detecting sensor and the sheet trailing end pressing member when the stack tray is lowered.

The stopping operation of the sheet trailing end pressing member 98 after the sheet trailing end pressing member 98 is moved to the pressing position on the stack tray 80 and to the retracted position in the main body la of the apparatus on forward and reverse rotations of the drive motor 92 is effected while being regulated by a rotational amount regulating mechanism shown in FIGS. 23 and 24.

When the drive motor 92 is rotated in the forward direction to rotate the drive gear 141 in the clockwise direction and the intermediate gear 142 in the counterclockwise direction, the sector gear 142 is rotated in the clockwise direction (in the forward direction) in FIG. 23 through a predetermined amount and then is stopped because of disengagement between the sector gear 143 and the intermediate gear 142. As a result, the sheet trailing end pressing member 98 is stopped at a position in which the sheet trailing end pressing member 98 is protruded into the sheet pressing position (FIGS. 20 and 23).

When the drive motor 92 is rotated in the reverse direction to rotate the drive gear 141 in the counterclockwise direction and the intermediate gear 142 in the clockwise direction, the sector hear 143 is rotated in the counterclockwise direction (in the reverse direction) in FIG. 23 through a predetermined amount and then is stopped because of disengagement between the sector gear 143 and the intermediate gear 142. As a result, the sheet trailing end pressing member 98 is stopped at a position in which the sheet trailing end pressing member 98 is retracted in the retracted position. In this way, after the sheet trailing end pressing member 98 is rotated to the sheet pressing position and the retracted position through the predetermined amount, the rotation of the sheet trailing end pressing member 98 is regulated by the rotational amount regulating mechanism, and the drive gear 141 and the intermediate gear 142 are merelt rotated idly.

In FIG. 19, the trailing end of the sheet bundle discharged on the stack tray 80 by the bundle discharging belt 60 is engaged by and supported on the sheet trailing end pressing member 98. In this case, since the sheet bundle on the stack tray 80 is pressed by the sheet trailing end pressing member 98, the sheet bundle on the stack tray 80 cannot be moved by the sheet bundle being discharged. Further, a length L of an engagement portion at a lower part of the sheet trailing end pressing member 98 is set to be greater than a flying amount of the sheet bundle $S_0$ being bundle-discharged, so that the trailing end of the sheet bundle $S_0$ is surely held by the sheet trailing end pressing member 98 in the bundle discharging and the trailing end of the discharged sheet bundle is prevented from being caught by the sheet trailing end pressing member 98 to distort the alignment.

After the sheet bundle is discharged onto the stack tray 80, when the stack tray 80 is lowered, the sheet trailing end pressing member 98 is retracted from the sheet pressing position shown in FIG. 19 to the retracted position 98A by the action of the rotational amount regulating mechanism shown in FIG. 24, thereby releasing the trailing end of the sheet bundle $S_0$.

After the sheet bundle is stacked on the stack tray 80, the stack tray 80 is lowered by a predetermined amount and then lifted again. As a result, the trailing end of the sheet bundle is frictionally slid against the guide surface 99, thereby eliminating any curl in the sheet bundle and aligning the trailing ends of the sheet bundles.

When the stack tray 80 is lifted, the sheet trailing end pressing member 98 is rotated to the sheet pressing position by the action of the rotational amount regulating mechanism shown in FIG. 23 so that the sheet trailing end pressing member 98 abuts against the upper surface of the lifted sheet bundle to press the sheet bundle. With this pressing action, even if there is any curled sheet, the proper sheet surface height is maintained.

When the sheet surface height detecting sensor 97 shown in FIG. 19 leaves the sheet bundle in response to the lowering movement of the stack tray 80, the photo-interrupter 132 is turned OFF. However, when the sheet surface height detecting sensor 97 is pushed again by the upper surface of the sheet bundle in response to the lifting movement of the stack tray 80, as shown in FIG. 20, the sheet surface height detecting sensor 97 turns the photo-interrupter 132 ON, thereby detecting the sheet surface height. After the detection of the sheet surface height, the stack tray 80 is lifted by a predetermined amount (for example, about 12 mm) and then is stopped. In this case, the sheet trailing end pressing member 98 presses the upper surface of the sheet bundle with proper pressure.

Figure 25:
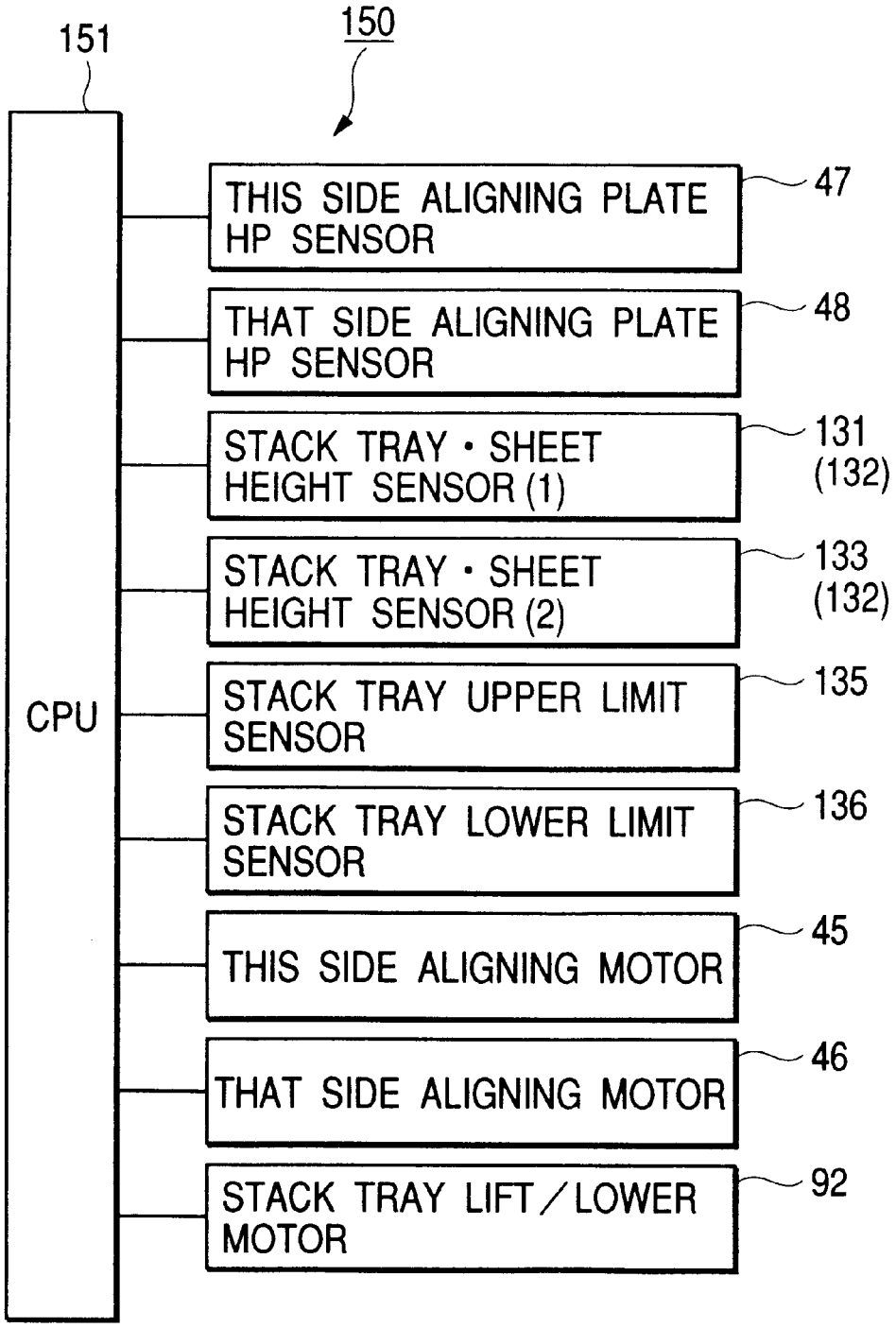
FIG. 25 is a block diagram for controlling the sheet treating apparatus.

Control of the lifting/lowering movement of the stack tray 80 is effected by a control device 150 including a CPU 151 (FIG. 25).

In this way, by arranging the sheet surface height detecting sensor 97 in the vicinity of the sheet trailing end pressing member 98, proper detection of the sheet surface height and the pressing operation of the sheet trailing end pressing member 98 with proper pressure can be realized. Further, since the trailing end of the sheet bundle bundle-discharged by the bundle discharging belt 60 is held by the sheet trailing end pressing member 98, the sheet bundle can be bundle-discharged without pushing out the already stacked sheet bundle(s).

Figure 22:
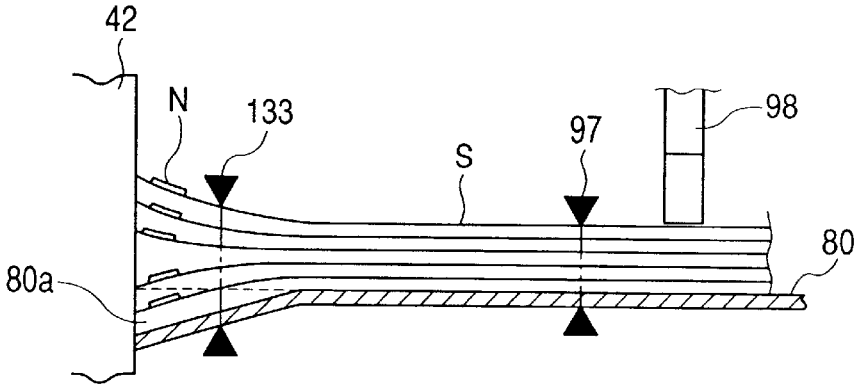
FIG. 22 is a vertical sectional front view showing an arrangement position of a plurality of sheet surface height detecting sensors for detecting a height level of sheets on the stack tray.

When the sheet bundle discharged onto the stack tray 80 has already stapled by the stapler 10 on the treatment tray 30, as shown in FIG. 22, one corner of the sheet bundles is swollen by the presence of staples, with the result that the sheet surface height is locally increased.

A recess 80*a* is formed in the stack tray 80 at a position in which the staples are located, thereby reducing the swelling of the stapled portions of the sheet bundles more or less.

The detection of the sheet surface height of the stitched side of the sheet bundle is effected by a sheet surface height detecting sensor 133, and this sheet surface height detecting sensor 133 is disposed at a spaced position from a central position in which the sheet trailing end pressing member 98 is disposed toward the stapler 10.

Thus, if the stitched portions of the sheet bundles are swollen, the sheet surface height at a highest position can be detected properly, and a state that the stitched portions of the sheet bundles are protruded upwardly from the stack tray 80 and inconvenience caused thereby can be prevented. Further, by utilizing the photo-interrupter 132 of the sheet surface height detecting sensor 97 also as a photo-interrupter of the sheet surface height detecting sensor 133, the number of parts can be reduced and the control can be simplified.

<Sheet flow>

Next, a flow of the sheet S in the sheet treating apparatus 1 will be explained with reference to FIG. 1 and FIGS. 26 to 29. First of all, an operation when a non-sort mode is selected in an operating portion (not shown) of the main body 300 of the image forming apparatus will be described.

When the operator sets the originals on the original feeder 305 of circulating type and turns ON a start key (not shown), an image is formed on the sheet S in the main body 300 of the image forming apparatus and the pair of discharge rollers 9 of the sheet treating apparatus 1 are rotated. The sheet S discharged from the pair of discharge rollers 399 of the main body 300 of the image forming apparatus is directed into the sheet treating apparatus 1 and is conveyed therein.

Figure 26:
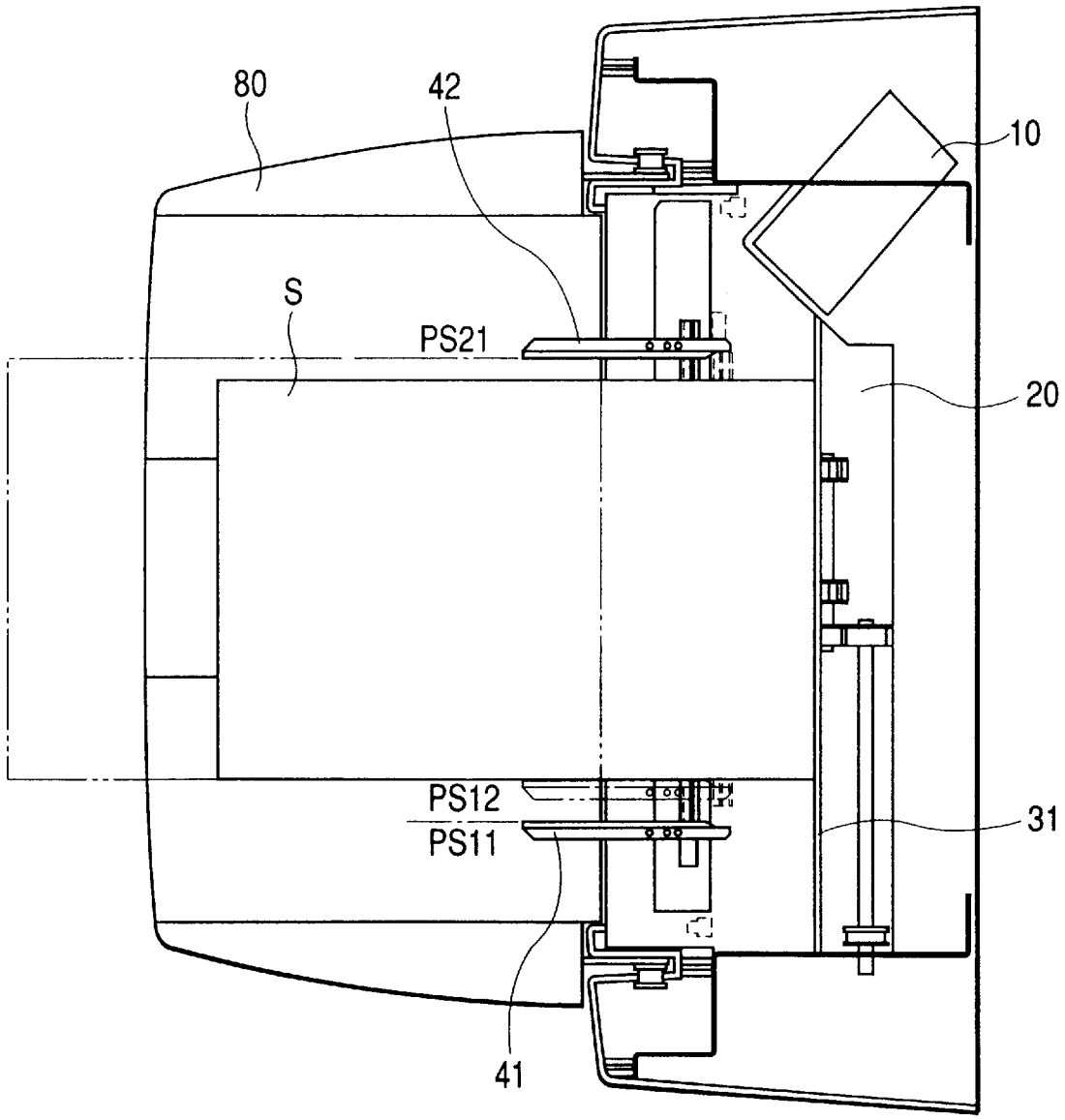
FIG. 26 is a plan view showing alignment plate waiting positions in a non-sort mode and a sort mode of the sheet treating apparatus.

First of all, as shown in FIG. 26, when there is no sheet S on the treatment tray 30, i.e., when a first sheet S of the job is discharged, the aligning members 41, 42 which are waiting at the home positions on this side and that side are previously moved to have a distance therebetween slightly greater than the width of the sheet S.

The discharged sheet S starts to move toward the trailing end stopper 31 by its own weight, and the back rollers 50 which are waiting at their home positions are rotated in the counterclockwise direction in FIG. 1 by the motor 70 to help in moving the sheet S toward the trailing end stopper 31.

Figure 27:
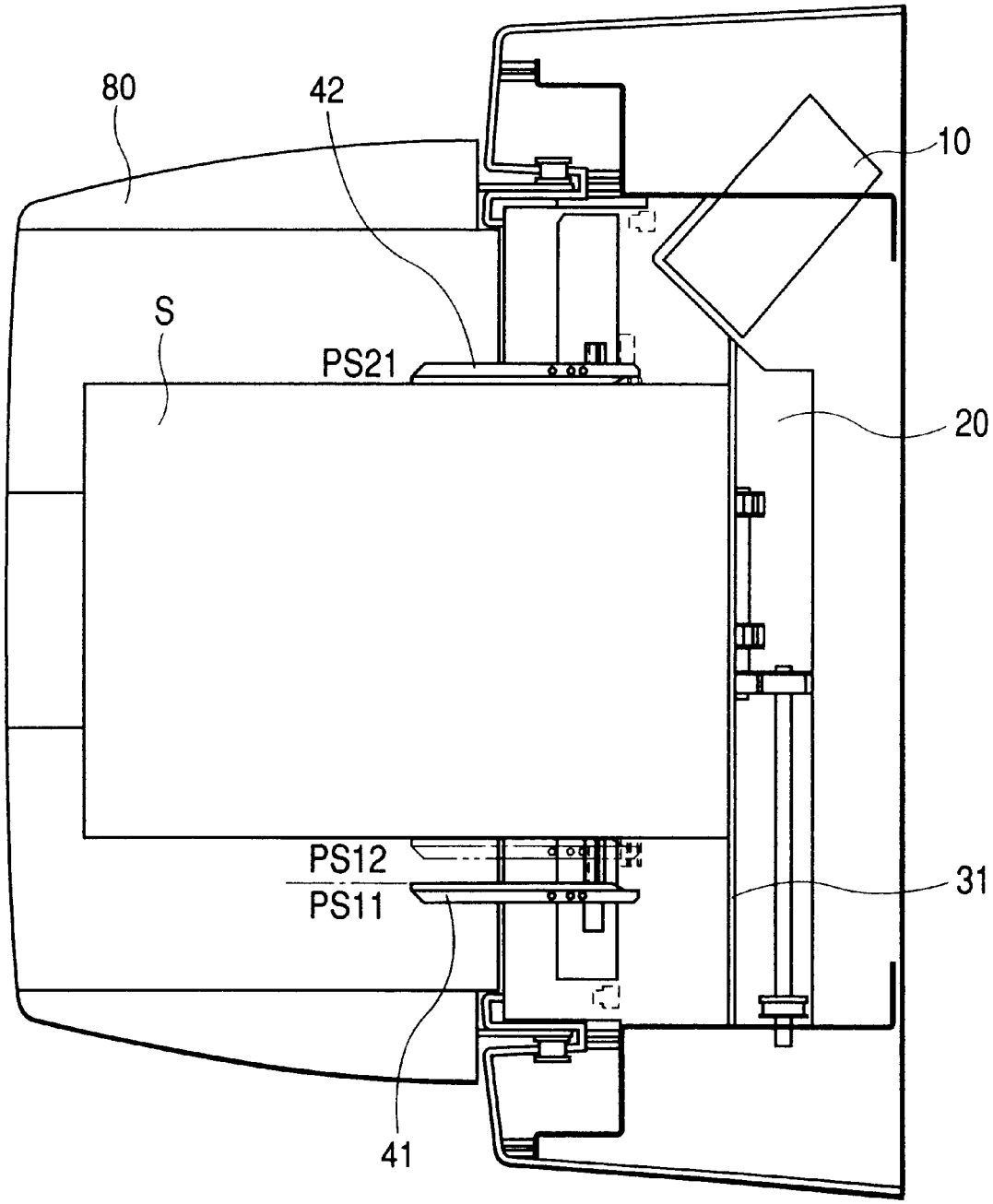
FIG. 27 is a plan view showing a first aligning position of the alignment plate in the non-sort mode and the sort mode of the sheet treating apparatus.
Figure 28:
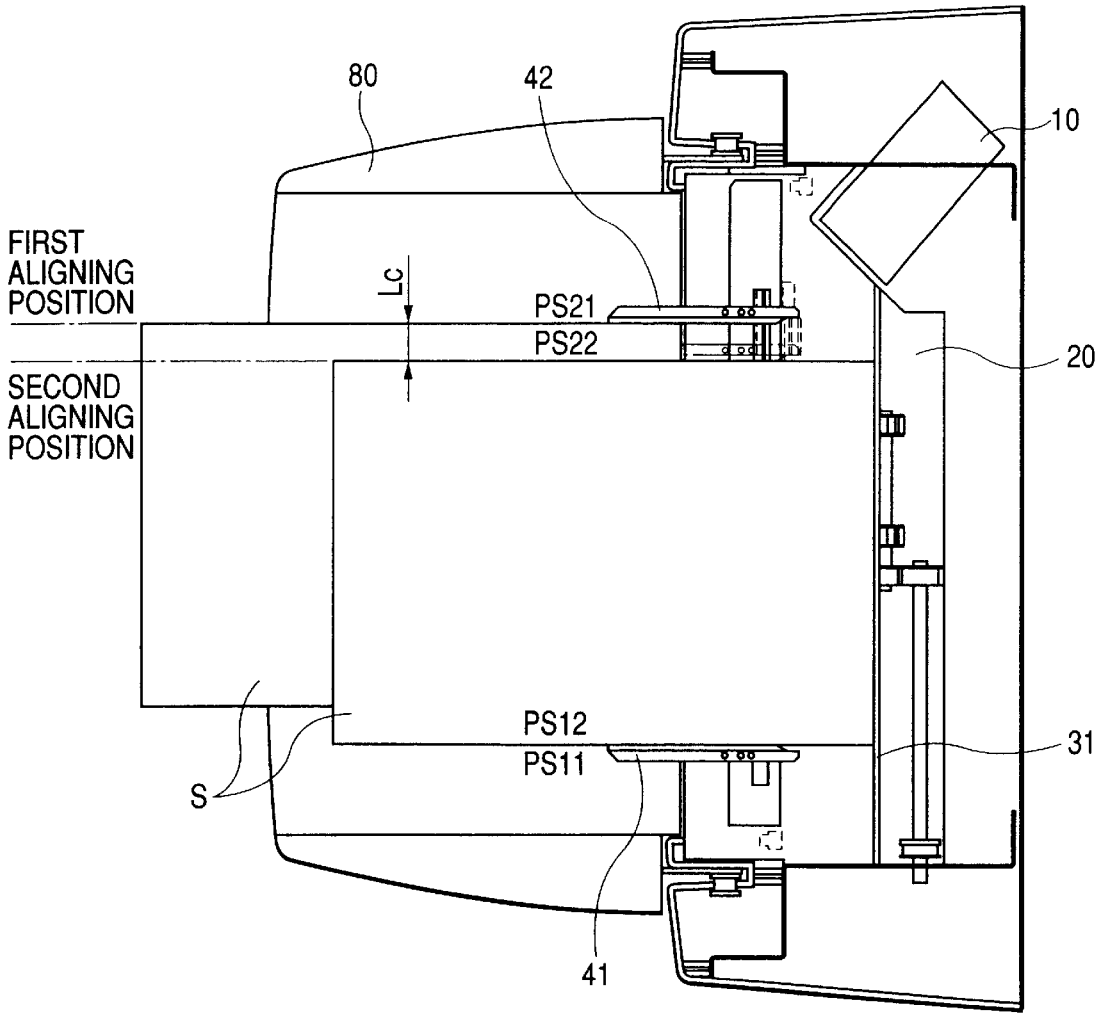
FIG. 28 is a plan view showing a second aligning position of the alignment plate in the non-sort mode and the sort mode of the sheet treating apparatus.

When the trailing end of the sheet S surely abuts against the trailing end stopper 31 and is stopped there, as shown in FIG. 27, the aligning member 42 on that side continues to be stopped at a position PS21 to act as a reference plate. The aligning member 41 on this side is moved to a position PS12 to align the sheet S at a first aligning position.

Next, an operation when the operator designates a sort mode will be described.

When the operator sets the originals on the original feeder 305 of circulating type, designates the sort mode in the operating portion (not shown) and turns ON the start key (not shown), an image is formed on the sheet S in the main body 300 of the image forming apparatus and the pair of discharge rollers 9 of the sheet treating apparatus 1 are rotated. The sheet S discharged from the pair of discharge rollers 399 of the main body 300 of the image forming apparatus is directed into the sheet treating apparatus 1 and is conveyed therein and then is discharged onto the treatment tray 30 by the pair of discharge rollers 9.

First of all, as shown in FIG. 26, when there is no sheet S on the treatment tray 30, i.e, when a first sheet S of the job is discharged, the aligning members 41, 42 which are waiting at the home positions on this side and that side are previously moved to have a distance therebetween slightly greater than the width of the sheet S.

The discharged sheet S starts to move toward the trailing end stopper 31 by its own weight, and the back rollers 50 which are waiting at their home positions are rotated in the counterclockwise direction FIG. 1 by the motor 70 to help in moving the sheet S toward the trailing end stopper 31.

When the trailing end of the sheet S surely abuts against the trailing end stopper 31 and is stopped there, as shown in FIG. 27, the aligning member 42 on that side is stopped and the aligning member 41 on this side is moved to move the sheet S to the first aligning position, thereby aligning the sheet S.

Thereafter, the aligning member 41 on this side is moved to a position PS11 and is waiting at the position PS11 for preparation for a next discharged sheet S. After the discharging of the sheet S is completed, the aligning member 41 on this side is moved to the position PS12 again, thereby aligning the sheet S at the first aligning position. In this case, the aligning member 42 on that side continues to be stopped at the position PS21 to act as the reference plate. The above-mentioned operations are repeated until a last sheet of that sheet bundle is treated.

The aligned sheet bundle S of the first copy is bundle-discharged as mentioned above to be moved onto the stack tray 80.

Then, a sheet bundle S of the second copy is discharged onto the treatment tray 30. In this case, as is in the first copy, although the aligning members 41, 42 are waiting at the positions PS11, PS21 as shown in FIG. 26, the aligning position is moved to a second aligning position shown in FIG. 28. The second aligning position is deviated from the first aligning position toward this side by a predetermined amount of $L_c$.

Thereafter, for every sheet bundle, the sheet bundle S are successively stacked on the stack tray 80 while changing the aligning positions alternately, so that the sorted stacking can be permitted with the deviation amount of $L_c$.

Next, an operation when the operator designates a staple sort mode will be described.

When the operator sets the originals on the original feeder 305 of circulating type and turns ON the start key (not shown), an image is formed on the sheet S in the main body 300 of the image forming apparatus and the pair of discharge rollers 9 of the sheet treating apparatus 1 are rotated. The sheet S discharged from the pair of discharge rollers 399 of the main body 300 of the image forming apparatus is directed into the sheet treating apparatus 1 and is conveyed therein and then is discharged onto the treatment tray 30 by the pair of discharge rollers 9.

The discharged sheet S starts to move toward the trailing end stopper 31 by its own weight, and the back rollers 50 which are waiting at their home positions are rotated in the anti-clockwise direction in FIG. 1 by the motor 70 to help in moving the sheet S toward the trailing end stopper 31.

Figure 29:
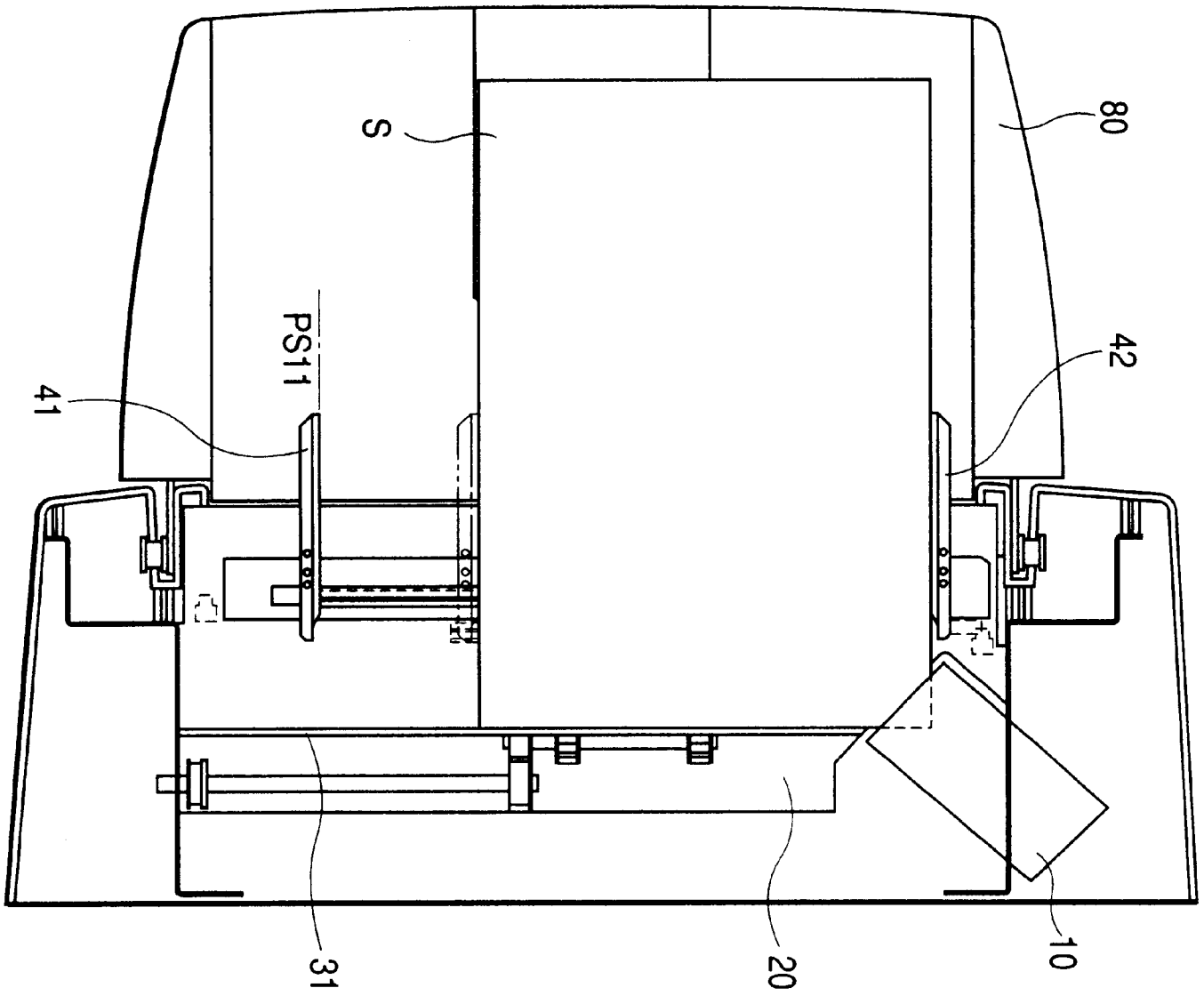
FIG. 29 is a plan view showing an aligning operation of the alignment plate in a staple sort mode of the sheet treating apparatus.

When the trailing end of the sheet S surely abuts against the trailing end stopper 31 and is stopped there, the aligning plate 41 is stopped at the home position and the aligning plate 42 conveys the sheet S discharged on the trailing end stopper 31 up to a staple position and aligns the sheet there (FIG. 29).

After all of the sheets S of a sheet bundle S of the first copy are discharged onto the treatment tray 30 and are aligned, the stapler 10 staples the sheet bundle S. The sheet bundle S on the treatment tray 30 is bundle-discharged onto the stack tray 80 by the bundle discharging belt 60.

Upon bundle discharging in the above-mentioned modes, the aligning plates 41, 42 are slightly widened, thereby reducing the load acting on the motor 70 during the bundle discharging, improving the endurance of the aligning plates and preventing poor bundle discharging.

What is claimed is:

1. A sheet treating apparatus comprising:

tray means liftable and lowerable while sheets are stacked on said tray means;

a sheet pressing member movable between a pressing position in which the sheets on said tray means are pressed by said sheet pressing member and a retracted position;

sheet pressing member driving means for retracting said sheet pressing member when said tray means is lowered and for moving said sheet pressing member to said pressing position when said tray means is lifted; and detecting means for detecting a height position of the sheets on said tray means to stop lifting said tray means.

2. A sheet treating apparatus according to claim 1, wherein said sheet pressing member receives a trailing end of a discharged sheet in said the pressing position.

3. A sheet treating apparatus according to claim 2, wherein the sheets are discharged as a sheet bundle and said tray means is lowered and lifted every time the sheet bundle is discharged.

4. A sheet treating apparatus according to claim 3, wherein a treatment tray is provided upstream of said tray means, and, after the sheets are stacked on said treatment tray, the sheets are discharged as the sheet bundle onto said tray means.

5. A sheet treating apparatus according to claim 4, further comprising forward and reverse rotatable driving means for lifting and lowering said tray means, wherein, when said tray means is lowered, said sheet pressing member is retracted, by said forward and reverse rotatable driving means, from said pressing position for pressing the trailing end of the sheet to said retracted position, and, when said tray means is lifted, said sheet pressing member is rotated to said pressing position to press the trailing end of the sheet on said tray means.

6. A sheet treating apparatus according to claim 5, further comprising a rotational amount regulating mechanism for regulating rotation of said pressing member to said pressing position and said retracted position, wherein said rotational amount regulating mechanism comprises a sector gear secured to a support shaft to which said sheet pressing member is attached, and an intermediate gear meshed with said sector gear and driven by said forward and reverse rotatable driving means so that, when said forward and reverse rotatable driving means is rotated in a forward direction to lift said tray means, said intermediate gear rotates said sector gear forwardly through a predetermined amount to rotate said sheet pressing member to said pressing position, and, when said forward and reverse rotatable driving means is rotated in a reverse direction to lower said tray means, said intermediate gear rotates said sector gear reversely through a predetermined amount to retract said sheet pressing member to said retracted position.

7. A sheet treating apparatus according to claim 6, wherein said sheet pressing member has an engagement portion for holding a trailing end of the sheet bundle being discharged onto said tray means, and a length of said engagement portion is selected to be greater than a flying amount of the sheet bundle being discharged onto said tray means.

8. A sheet treating apparatus according to claim 1, wherein said detecting means for detecting the height position of the sheets on said tray means is disposed in a vicinity of said sheet pressing member.

9. An image forming apparatus comprising:

a sheet treating apparatus as recited in any one of claims 1 to 8;

image forming means for forming an image on a sheet in response to image information; and discharging means for discharging the sheet on which the image is formed by said image forming means into said sheet treating apparatus.

* * * * *

UNITED STATES PATENT AND TRADEMARK OFFICE

CERTIFICATE OF CORRECTION

PATENT NO. : 6,302,389 B1
DATED : October 16, 2001
INVENTOR(S) : Katsuhito Kato et al.

It is certified that error appears in the above-identified patent and that said Letters Patent is hereby corrected as shown below:

Title page,
Item [56], References Cited, FOREIGN PATENT DOCUMENTS, "0143167" should read -- 63-43167 --.

Item [57], ABSTRACT,
Line 7, "for moving" should read -- moves --.

Column 2,
Line 18, "affecting" should read -- effecting --; and
Line 47, "treat" should read -- treatment --.

Column 5,
Line 25, "staced" should read -- stacked --; and
Line 33, "A" should read -- ¶A --.

Column 6,
Line 57, "figuration and" should read -- figuration, is --.

Column 7,
Line 2, "shift 51" should read -- shaft 51 --;
Line 4, "receives" should read -- receive --;
Line 6, "an" should read -- a --;
Line 45, "plate 41" should read -- member 41 --;
Line 56, "plate 41" should read -- member 41 --; and
Line 59, "plate 42" should read -- member 42 --.

Column 8,
Line 20, "plate 41" should read -- member 41 --;
Line 32, "plate 41 (42)," should read -- plate 41*a* (42*a*), --;
Line 33, "plate 41" should read -- member 41 --;
Line 34, "the" (second occurrence) should be deleted;
Line 37, "41" should read -- 41*a* -- and "plate 42" should read -- plate 42*a* --;
Line 43, "plates" should read -- members --;
Line 48, "plate 41" should read -- member 41 --;
Line 51, "plates 41, 42," should read -- plates 41*a*, 42*a*, --;
Line 55, "plate 41" should read -- member 41 --; and
Line 63, "plate 41." should read -- member 41. --.

UNITED STATES PATENT AND TRADEMARK OFFICE

CERTIFICATE OF CORRECTION

PATENT NO. : 6,302,389 B1
DATED : October 16, 2001
INVENTOR(S) : Katsuhito Kato et al.

It is certified that error appears in the above-identified patent and that said Letters Patent is hereby corrected as shown below:

Column 9,
Line 3, "portion 41*a*" should read -- plate 41*a* --;
Line 5, "plate 41." should read -- member 41. -- and "portion 41*a*" should read -- plate 41*a* --;
Line 8, "plates 41, 42." should read -- members 41, 42. --;
Line 9, "portion 41*a*" should read -- plate 41*a* --;
Line 28, "plates 41, 42" should read -- plates 41*a*, 42*a* --;
Line 33, "plates 41, 42," should read -- plates 41*a*, 42*a*, --;
Line 37, "plates 41, 42" should read -- plates 41*a*, 42*a* --;
Line 42, "plates 41 and 42" should read -- plates 41*a* and 42*a* --;
Line 45, "plates 41" should read -- plates 41*a* --;
Line 46, "and 42" should read -- and 42*a* --;
Line 49, "plates 41 and 42" should read -- plates 41*a* and 42*a* --; and
Line 54, "plates 41, 42" should read -- plates 41*a*, 42*a* --.

Column 10,
Line 40, "body *l*a" should read -- body 1*a* --; and
Line 62, "body *1*a" should read -- body 1*a* --.

Column 11,
Line 2, "gear 142" should read -- gear 143 --.

Column 14,
Line 11, "anti-clockwise" should read -- counterclockwise --;
Line 15, "plate 41" should read -- plate 41*a* --;
Line 16, "plate 42" should read -- plate 42*a* --;
Line 24, "plates 41, 42" should read -- plates 41*a*, 42*a* --;
Line 46, "said" should be deleted;
Line 49, "the" should read -- a --; and
Line 54, "the" (second occurrence) should read -- a --.

Column 15,
Line 10, "through" should read -- by --;
Line 15, "through" should read -- by --; and
Line 19, "the" should read -- a --.

UNITED STATES PATENT AND TRADEMARK OFFICE

CERTIFICATE OF CORRECTION

PATENT NO. : 6,302,389 B1
DATED : October 16, 2001
INVENTOR(S) : Katsuhito Kato et al.

It is certified that error appears in the above-identified patent and that said Letters Patent is hereby corrected as shown below:

Column 16,
Line 3, "the" should read -- a --.

Signed and Sealed this

Seventh Day of January, 2003

JAMES E. ROGAN
*Director of the United States Patent and Trademark Office*